US010459356B2

(12) United States Patent
Takeno et al.

(10) Patent No.: US 10,459,356 B2
(45) Date of Patent: Oct. 29, 2019

(54) CHARGING MEMBER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Kineo Takeno, Suntou-gun (JP); Noriyuki Doi, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 161 days.

(21) Appl. No.: 15/716,666

(22) Filed: Sep. 27, 2017

(65) Prior Publication Data

US 2018/0101106 A1 Apr. 12, 2018

(30) Foreign Application Priority Data

Oct. 7, 2016 (JP) ..... 2016-199271
Sep. 7, 2017 (JP) ..... 2017-172099

(51) Int. Cl.
*G03G 5/06* (2006.01)
*G03G 15/02* (2006.01)

(52) U.S. Cl.
CPC ..... *G03G 5/0662* (2013.01); *G03G 5/0622* (2013.01); *G03G 15/0233* (2013.01)

(58) Field of Classification Search
CPC ..... G03G 5/0622; G03G 5/0662; G03G 21/1814; G03G 15/0233; C07F 7/28; C07F 7/003; C07F 5/069; C07F 11/005
See application file for complete search history.

(56) References Cited

U.S. PATENT DOCUMENTS 5,358,814 A 10/1994 Osterhoudt et al.
9,556,359 B2 1/2017 Suzumura et al.
2013/0295330 A1* 11/2013 Kodama ..... G03G 15/02 428/147
2014/0072343 A1 3/2014 Masu et al.
2014/0080691 A1 3/2014 Kurachi et al.
2014/0295336 A1* 10/2014 Miyagawa ..... G03G 21/18 430/56
2015/0331348 A1 11/2015 Doi et al.
2016/0161877 A1 6/2016 Masu et al.
2016/0252842 A1 9/2016 Sakurai et al.
2016/0299450 A1* 10/2016 Takeno ..... G03G 15/0233
2016/0378010 A1 12/2016 Doi et al.

FOREIGN PATENT DOCUMENTS

JP 2001-355628 A 12/2001

* cited by examiner

*Primary Examiner* — Christopher M Rodd
(74) *Attorney, Agent, or Firm* — Venable LLP

(57) ABSTRACT

A charging member is provided that has high charging ability and can prevent generation of abnormal discharge even under an environment at a low temperature and a low humidity. The charging member includes an electroconductive support, an electroconductive elastic layer and a surface layer. The electroconductive elastic layer contains electrically insulating domains such that at least a part of the electrically insulating domains is exposed on the surface of the electroconductive elastic layer. The surface layer contains a polymetalloxane having a structure represented by Structural Formula (a1), and M1 in Structural Formula (a1) and a carbon atom in a structural unit represented by Structural Formula (a2) are bonded through a linking group represented by Structural Formula (a3).

Structural Formula (a1)

$$M1O_{(k-(s+1))/2}(L1)_s$$

Structural Formula (a2)

Structural Formula (a3)

*2—O—Z—*1

12 Claims, 8 Drawing Sheets

CHARGING MEMBER, PROCESS CARTRIDGE AND ELECTROPHOTOGRAPHIC IMAGE FORMING APPARATUS

BACKGROUND OF THE INVENTION

Field of the Invention

The present invention relates to a charging member, a process cartridge including the charging member, and an electrophotographic image forming apparatus (hereinafter, referred as "electrophotographic apparatus").

Description of the Related Art

One of methods of charging the surfaces of electrophotographic photosensitive members (hereinafter referred as "photosensitive members") is a contact charging method. In the contact charging method, voltage is applied to a charging member disposed on the photosensitive member to be in contact therewith and very small discharge is generated near the contact portion between the charging member and the photosensitive member to charge the surface of the photosensitive member. The contact charging method usually uses a charging member including an electroconductive elastic layer to achieve a desired electric resistance. It is known that the electric resistance of the electroconductive elastic layer varies due to moisture and water absorption. To reduce such a variation in electric resistance due to moisture and water absorption, Japanese Patent Application Laid-Open No. 2001-355628 discloses formation of an inorganic oxide coating film on an electroconductive elastic layer of an electroconductive roll by a sol-gel method.

Photosensitive members have been charged in a relatively short time because of a recent increase in the speed of the electrophotographic image forming process. Such a short charging time is disadvantageous in stable and ensuring charging of the photosensitive members.

The present inventors, who have conducted extensive research, have found that if the electroconductive roll described in Japanese Patent Application Laid-Open No. 2001-355628 is used as a charging member, strong local discharge (abnormal discharge) may occur particularly under an environment at a low temperature and a low humidity because of the increased process speed. The present inventors have also found that unevenness of images in order of several tens of micrometers to several millimeters may occur due to the abnormal discharge.

SUMMARY OF THE INVENTION

One aspect of the present invention is directed to providing a charging member that has high charging ability and can prevent generation of strong local discharge (abnormal discharge) even under an environment at a low temperature and a low humidity. Another aspect of the present invention is directed to providing a process cartridge and an electrophotographic apparatus which can prevent generation of strong local discharge (abnormal discharge) even under an environment at a low temperature and a low humidity, and can form high-quality electrophotographic images.

According to one aspect of the present invention, provided is a charging member including an electroconductive support, an electroconductive elastic layer and a surface layer, the electroconductive elastic layer containing electrically insulating domains such that at least a part of the electrically insulating domains is exposed on the surface of the electroconductive elastic layer, and the surface layer containing a polymetalloxane having a structure represented by Structural Formula (a1); M1 in Structural Formula (a1) being bonded to a carbon atom in a structural unit represented by Structural Formula (a2) with a linking group represented by Structural Formula (a3):

Structural Formula (a1)

$$M1O_{(k-(s+1))/2}(L1)_s$$

Structural Formula (a2)

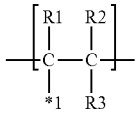

Structural Formula (a3)

$$*2—O—Z—*1$$

where in Structural Formula (a1),

M1 represents a metal atom selected from the group consisting of Ti, Zr, Hf, V, Nb, Ta, W, Al, Ga, In and Ge;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5;

s represents an integer of 0 or more and (k−2) or less; and

L1 represents a ligand having a structure represented by Formula (b) or a ligand having a structure represented by Formula (c);

(b)

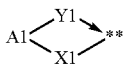

where in Formula (b),

X1 represents a structure represented by one of Formulae (1) to (4);

Y1 represents a group having a site of coordination with M1 in Structural Formula (a1);

A1 represents a direct bond or an atomic group needed to form a 4- to 8-membered ring with M1, X1 and Y1; and a symbol "**" represents a site of bonding to or coordination with M1;

(1)

$$*—O—$$

(2)

$$*—\overset{|}{N}—$$

(3)

$$*—S—$$

(4)

$$*—CO—O—$$

where in Formulae (1) to (4), a symbol "" represents a site of bonding to M1 in Structural Formula (a1); and a symbol "*" represents a site of bonding to A1 in Formula (b);

(c)

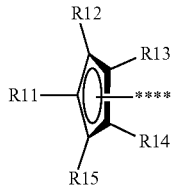

where in Formula (c),

R11 to R15 each independently represent a hydrogen atom, an alkyl group having 1 to 4 carbon atoms, or a trimethylsilyl group; and a symbol "****" represents a site of coordination with M1 in Structural Formula (a1);

where in Structural Formula (a2),

R1 to R3 each independently represent a hydrogen atom or an alkyl group having 1 to 3 carbon atoms; and a symbol "*1" represents a site of bonding to Z in Structural Formula (a3); and where in Structural Formula (a3), Z represents a substituted or unsubstituted phenylene group, provided that the substituent in the substituted phenylene group is a halogen atom or an alkyl group having 1 to 3 carbon atoms;

a symbol "*1" represents a site of bonding to the symbol "*1" in Structural Formula (a2); and a symbol "*2" represents a site of bonding to M1 in Structural Formula (a1).

Another embodiment according to the present invention provides a process cartridge detachably attachable to the main body of an electrophotographic apparatus, the process cartridge integrally supporting an electrophotographic photosensitive member and a charging member for charging the surface of the electrophotographic photosensitive member, wherein the charging member is the charging member.

Further, another embodiment according to the present invention provides an electrophotographic apparatus including an electrophotographic photosensitive member and a charging member for charging the surface of the electrophotographic photosensitive member, wherein the charging member is the charging member.

Further features of the present invention will become apparent from the following description of exemplary embodiments with reference to the attached drawings.

DESCRIPTION OF THE EMBODIMENTS

Figure 1:
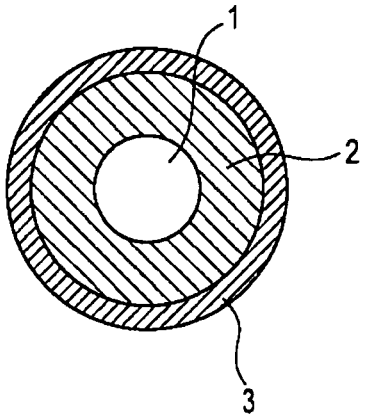
FIG. 1 is a schematic cross-sectional view illustrating one example of the charging member according to the present invention.

Preferred embodiments of the present invention will now be described in detail in accordance with the accompanying drawings.

Photoreceptors have been charged in a relatively short time because of a recent increase in the speed of the electrophotographic image forming process, which causes disadvantages for stable and ensuring charging of the photosensitive members.

The present inventors, who have conducted research, have found that if the electroconductive roll described in Japanese Patent Application Laid-Open No. 2001-355628 is used as a charging member, strong local discharge (abnormal discharge) may occur particularly under an environment at a low temperature and a low humidity because of the increased process speed. The present inventors have also found that unevenness of images in order of several tens of micrometers to several millimeters may occur due to the abnormal discharge.

The present inventors have repeatedly conducted research to achieve a charging member having high charging ability to prevent generation of abnormal discharge. As a result, the present inventors have found that a charging member including a surface layer containing a polymetalloxane having a specific structure can significantly effectively prevent generation of abnormal discharge.

The charging member according to one aspect of the present invention includes an electroconductive support, an electroconductive elastic layer and a surface layer. The electroconductive elastic layer contains electrically insulating domains such that at least a part of the electrically insulating domains is exposed on the surface of the electroconductive elastic layer.

The surface layer contains a polymetalloxane having a structure represented by Structural Formula (a1), and M1 in Structural Formula (a1) and a carbon atom in a structural unit represented by Structural Formula (a2) are bonded through a linking group represented by Structural Formula (a3):

Structural Formula (a1)

$$M1O_{(k-(s+1))/2}(L1)_s$$

Structural Formula (a2)

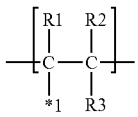

-continued

Structural Formula (a3)

*2—O—Z—*1 where in Structural Formula (a1),

M1 represents a metal atom selected from the group consisting of Ti, Zr, Hf, V, Nb, Ta, W, Al, Ga, In and Ge;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5;

s represents an integer of 0 or more and (k−2) or less; and

L1 represents a ligand having a structure represented by Formula (b) or a ligand having a structure represented by Formula (c);

(b)

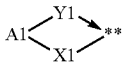

where in Formula (b),

X1 represents a structure represented by one of Formulae (1) to (4);

Y1 represents a group having a site of coordination with M1 in Structural Formula (a1);

A1 represents a direct bond or an atomic group needed to form a 4- to 8-membered ring with M1, X1 and Y1; and a symbol "**" represents a site of bonding to or coordination with M1;

(1)

*—O—

(2)

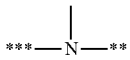

(3)

*—S—

(4)

*—CO—O— where in Formulae (1) to (4), a symbol "" represents a site of bonding to M1 in Structural Formula (a1); and a symbol "*" represents a site of bonding to A1 in Formula (b);

(c)

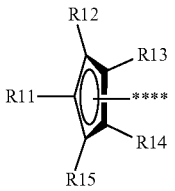

where in Formula (c),

R11 to R15 each independently represent a hydrogen atom, an alkyl group having 1 to 4 carbon atoms, or a trimethylsilyl group; and a symbol "****" represents a site of coordination with M1 in Structural Formula (a1);

where in Structural Formula (a2),

R1 to R3 each independently represent a hydrogen atom or an alkyl group having 1 to 3 carbon atoms; and a symbol "*1" represents a site of bonding to Z in Structural Formula (a3); and where in Structural Formula (a3), Z represents a substituted or unsubstituted phenylene group, provided that the substituent in the substituted phenylene group is a halogen atom or an alkyl group having 1 to 3 carbon atoms;

a symbol "*1" represents a site of bonding to the symbol "*1" in Structural Formula (a2); and a symbol "*2" represents a site of bonding to M1 in Structural Formula (a1).

A charging member having such a configuration can prevent generation of abnormal discharge even under an environment at a low temperature and a low humidity.

The charging member can prevent generation of abnormal discharge for the following reasons.

A proximity discharge phenomenon in the air is generated according to the Paschen's law. This phenomenon indicates diffusion of electron avalanche generated through repeated collision of free electrons accelerated in an electric field with molecules present between electrodes and the electrodes to generate electrons, cations and anions. This electron avalanche diffuses according to the electric field, and diffusion determines the final amount of discharge. Generation of an electric field having a condition beyond that according to the Paschen's law will readily generate strong local discharge or abnormal discharge.

In particular, a smaller amount of molecules are present between electrodes under an environment at a low temperature and a low humidity than under normal temperature and normal humidity. For this reason, the discharge start voltage under an environment at a low temperature and a low humidity tends to be higher than the discharge start voltage derived from the Paschen's law. For this reason, an increase in discharge start voltage readily generates an electric field having a condition beyond that according to the Paschen's law, so that abnormal discharge readily occurs under low temperatures and low humidity in particular.

The electroconductive elastic layer of the charging member contains electrically insulating domains such that at least a part of the electrically insulating domains is exposed on the surface of the electroconductive elastic layer. For this reason, a voltage applied to the charging member generates a difference in electric field intensity between the electrically insulating domains and other regions on the surface of the charging member (hereinafter, also referred to as "electric field intensity distribution").

Herein, it is believed that in the surface layer according to this aspect, the metal atom M1 in metalloxane reacts with a phenolic hydroxyl group of a polymer containing a structural unit having a phenolic hydroxyl group to form a bond "—Z—O-M1" as represented in Structural Formula (a3). The polymetalloxane having such a bond has a shallower highest occupied molecular orbital (HOMO) than that of polymetalloxanes not having the bond.

The present inventors infer that this shallower highest occupied molecular orbital of the polymetalloxane allows electrons to be readily discharged from the surface layer in the charging member according to the present invention. For this reason, the charging member can have lower discharge start voltage to reduce the amount of discharge. For this reason, the present inventors believe that the charging member can effectively prevent generation of abnormal discharge. Such a surface layer having high electron releasing properties formed on the electrically insulating domains exposed on the surface of the electroconductive elastic layer can perform elaborate discharge according to the electric field intensity distribution formed by the electrically insulating domains.

Usually, discharge tends to be unstable according to the size and/or material of the electrically insulating substance. The surface layer according to the present invention can provide a state where electrons are readily released, enabling the elaborate discharge according to the electric field intensity distribution. It is believed that this elaborate discharge can prevent generation of the strong local discharge, that is, abnormal discharge described above.

<Charging Member>

The present invention will now be described in detail by way of a charging member in the form of a roller (hereinafter, also referred to as "charging roller") as a specific example of the charging member according to one aspect of the present invention. The charging member can have any shape, and may have a shape such as a roller or a plate.

FIG. 1 is a cross-sectional view of a charging roller including an electroconductive support 1, and an electroconductive elastic layer 2 formed on the support 1 and a surface layer 3. The charging member is disposed to be capable of charging the surface of the photosensitive member, and can include an electroconductive elastic layer to sufficiently ensure the contact nip with the photosensitive member. In the simplest configuration of the charging member including an electroconductive elastic layer, the charging member includes an electroconductive support, and two layers layer disposed thereon, i.e., an electroconductive elastic layer and a surface layer. The charging member may include one or two or more different layers between the electroconductive support and the electroconductive elastic layer as long as the configuration is satisfied.

[Electroconductive Support]

The electroconductive support needs to have sufficient rigidity for contact with the photosensitive member. A metal material can be used. Specifically, examples of the metal material include iron, copper, stainless steel, aluminum, aluminum alloys and nickel. A support formed of a resin reinforced with a filler can be used.

[Electroconductive Elastic Layer]

The electroconductive elastic layer can be formed of one or two or more materials selected from elastic materials conventionally used in the electroconductive elastic layer of the charging member, such as rubber and thermoplastic elastomers. Specifically, examples of the rubber include urethane rubber, silicone rubber, butadiene rubber, isoprene rubber, chloroprene rubber, styrene-butadiene rubber, ethylene-propylene rubber, polynorbornene rubber, acrylonitrile rubber, epichlorohydrin rubber and alkyl ether rubber. Examples of the thermoplastic elastomer include styrene elastomers and olefin elastomers.

An electroconductive agent contained in the electroconductive elastic layer gives predetermined electroconductivity to the electroconductive elastic layer. The electroconductive elastic layer can have an electric resistance of $1\times10^{2}\Omega$ or more and $1\times10^{8}\Omega$ or less. Examples of the electroconductive agent used in the electroconductive elastic layer include carbon materials, metal oxides, metals, cationic surfactants, anionic surfactants, amphoteric ion surfactants, charge preventing agents and electrolytes.

Specifically, examples of the carbon-based materials include electroconductive carbon black and graphite. Specifically, examples of the metal oxides include tin oxide, titanium oxide and zinc oxide. Specifically, examples of the metals include nickel, copper, silver and germanium.

Specifically, examples of the cationic surfactants include quaternary ammonium salts (lauryltrimethylammonium, stearyltrimethylammonium, octadodecyltrimethylammonium, dodecyltrimethylammonium, hexadecyltrimethylammonium and modified fatty acids/dimethylethylammonium), perchlorates, chlorates, fluoborates, ethosulfates and halogenated benzyl salts (benzyl bromide salts and benzyl chloride salts).

Examples of the anionic surfactants specifically include aliphatic sulfonates, higher alcohol sulfate esters, higher alcohol ethylene oxide adducted sulfate esters, higher alcohol phosphate esters and higher alcohol ethylene oxide adducted phosphate esters.

Examples of the charge preventing agents include nonionic charge preventing agents such as higher alcohol ethylene oxides, polyethylene glycol fatty acid esters and polyhydric alcohol fatty acid esters.

Examples of the electrolytes include salts of metals of Group I in the periodic table. Specifically, examples of the salts of metals of Group I in the periodic table include $LiCF_3SO_3$, $NaClO_4$, $LiAsF_6$, $LiBF_4$, NaSCN, KSCN and NaCl.

Another usable electroconductive agent for the electroconductive elastic layer can be salts of Group II metals in the periodic table ($Ca(ClO_4)_2$), or charge preventing agents derived from the metal salts. Furthermore, ion electroconductive electroconductive agents can be used, such as complexes of these salts and polyhydric alcohols (1,4-butanediol, ethylene glycol, polyethylene glycol, propylene glycol and polyethylene glycol) or derivatives thereof; or complexes of these salts and monools (ethylene glycol monomethyl ether and ethylene glycol monoethyl ether).

The electroconductive elastic layer can have a hardness (Asker C hardness) of 20 degrees or more and 90 degrees or less to prevent deformation of the charging member brought into contact with the photosensitive member as a charged member. The electroconductive elastic layer can have a so-called crown shape, that is, have a thickness of the central portion larger than that of ends in the axial direction to uniformly contact the photosensitive member in the transverse direction.

(Electrically Insulating Domains)

Figure 2A:
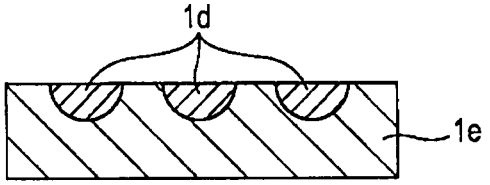
FIG. 2A is a diagram illustrating one example of the electrically insulating domains according to the present invention.
Figure 2B:
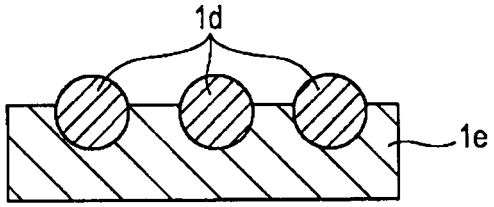
FIG. 2B is a diagram illustrating one example of the electrically insulating domains according to the present invention.
Figure 2C:
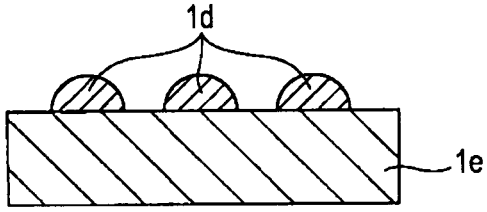
FIG. 2C is a diagram illustrating one example of the electrically insulating domains according to the present invention.

As illustrated in FIGS. 2A, 2B and 2C, the electroconductive elastic layer according to the present invention contains electrically insulating domains 1*d* such that at least part of the electrically insulating domains is exposed on the surface of the electroconductive elastic layer. The electrically insulating domains of the present invention include an electrical insulator having a volume resistivity of $1.0\times10^{13}$ Ω·cm or more. In contrast, a portion other than the electrically insulating domains (hereinafter, also referred to as "electroconductive portion 1*e*") includes an electroconductive material having a volume resistivity of $1.0\times10^{12}$ Ω·cm or less. The portion separates the electrically insulating domains from each other.

In this aspect, the electrically insulating domains and the electroconductive portion can have any configuration. Examples thereof include a configuration in which the electrically insulating domains 1*d* are embedded in the electroconductive portion 1*e* (FIG. 2A), a configuration in which the electrically insulating domains 1*d* are partially embedded into the electroconductive portion 1*e* (FIG. 2B), and a configuration in which the electrically insulating domains 1*d* are formed on the electroconductive portion 1*e* (FIG. 2C). Among these configurations, the electrically insulating domains can be projected from the surface of the electroconductive elastic layer as illustrated in FIG. 2B or 2C. The protrusions disposed on the surface of the electroconductive elastic layer change the distance between the charging member and the charged member to further enhance the electric field intensity distribution, demonstrating a higher effect of preventing abnormal discharge.

The electrically insulating domains 1*d* can have any shape, such as a spherical, cubic or cuboid shape. The electrically insulating domain can have an area of 1 $\mu m^2$ or more and 50000 $\mu m^2$ or less. Electrically insulating domains having an area within this range can ensure formation of the electric field intensity distribution on the surface of the charging member, further enhancing the effect of preventing abnormal discharge. In the present invention, the area of the electrically insulating domain is measured by the following method.

An image of the surface of the electroconductive elastic layer is photographed with an optical electron microscope (trade name: VK-8700, manufactured by Keyence Corporation). In the resulting image, the area of the electrically insulating domain is calculated. The diameter of a circle having an area identical to this area is determined, and is defined as the diameter of the electrically insulating domain.

The electrically insulating domain can have a diameter of 1 μm to 250 μm. Electrically insulating domains having a diameter within this range can ensure the formation of electric field intensity distribution on the surface of the charging member, further enhancing the effect of preventing abnormal discharge.

The electrically insulating domain can have a height of 1 μm or more. Electrically insulating domains having a height of 1 μm or more can ensure the formation of electric field intensity distribution on the surface of the charging member, further enhancing the effect of preventing abnormal discharge.

Examples of the method of exposing the electrically insulating domains from the surface of the electroconductive elastic layer include the following methods: a method (first method) of adding electrically insulating particles to electroconductive rubber or a thermoplastic elastomer to form an electroconductive elastic layer, and exposing the electrically insulating particles to form electrically insulating domains, or a method (second method) of feeding an electrically insulating material to an electroconductive elastic layer preliminarily formed.

(First Method)

One example of the first method will now be described in detail. First, electrically insulating particles having a volume resistivity of $1.0\times10^{13}$ Ω·cm or more are added to the electroconductive rubber for forming the electroconductive portion to prepare a mixture. The mixture is applied onto an electroconductive support by extrusion molding to form an electroconductive elastic layer. At this time, the rubber may be subjected to a heat treatment to be crosslinked. The surface of the electroconductive elastic layer is polished to expose the electrically insulating particles. An electroconductive elastic layer having electrically insulating domains exposed on the surface thereof can be thereby formed.

A so-called heat-expansible microcapsule can also be used as an electrically insulating particle. The heat-expansible microcapsule contains a capsuled substance inside the particle. The capsuled substance expands under heat to form a hollow resin particle. In this case, the heat-expansible microcapsule is added to the electroconductive rubber, and the electroconductive rubber is crosslinked through a heat treatment to expand the capsule. The capsule is then exposed form the surface of the electroconductive elastic layer. Projected electrically insulating domains can be thereby formed on the electroconductive elastic layer without polishing the surface thereof.

In addition of the electrically insulating particles, electrically insulating particles having a volume resistivity of $1.0\times10^{13}$ Ω·cm or more can be used without particular limitation. Examples of the electrically insulating particles include acrylic resins, styrene resins, polyamide resins, silicone resins, vinyl chloride resins, vinylidene chloride resins, acrylonitrile resins, fluorinated resins, phenol resins, polyester resins, melamine resins, urethane resins, olefin resins, epoxy resins, resins of copolymers thereof or derivatives thereof, ethylene-propylene-diene copolymer (EPDM), styrene-butadiene copolymerization rubber (SBR), silicone rubber, urethane rubber, isoprene rubber (IR), butyl rubber, chloroprene rubber (CR), and thermoplastic elastomers such as polyolefin thermoplastic elastomers, urethane thermoplastic elastomers, polystyrene thermoplastic elastomers, fluorocarbon rubber thermoplastic elastomers, polyester thermoplastic elastomers, polyamide thermoplastic elastomers, polybutadiene thermoplastic elastomers, ethylene vinyl acetate thermoplastic elastomers, poly(vinyl chloride) thermoplastic elastomers and chlorinated polyethylene thermoplastic elastomers.

Use of the heat-expansible microcapsule as the electrically insulating particles enables use of a gas having superior electrical insulation properties as the electrically insulating domains. In use of the heat-expansible microcapsule, a thermoplastic resin needs to be used as a shell material for the heat-expansible microcapsule. Examples of the thermoplastic resin include: acrylonitrile resins, vinyl chloride resins, vinylidene chloride resins, methacrylate resins, styrene resins, urethane resins, amide resins, methacrylonitrile resins, acrylate resins, acrylic acid ester resins and methacrylic acid ester resins. Among these resins, a thermoplastic resin containing at least one resin selected from acrylonitrile resins and methacrylonitrile resins having low gas permeability and high impact resilience can be used. These thermoplastic resins can be used singly or in combinations of two or more. Furthermore, monomers of these thermoplastic resins may be copolymerized, and may be used in the form of copolymers.

The substance (capsuled substance) encapsulated in the heat-expansible microcapsule can be a material which is vaporized at a temperature equal to or lower than the softening point of a thermoplastic resin contained in a shell material. Examples thereof include: low boiling point liquids such as propane, propylene, butene, normal butane, isobutane, normal pentane and isopentane; and high boiling point liquids such as normal hexane, isohexane, normal heptane, normal octane, isooctane, normal decane and isodecane.

The heat-expansible microcapsule can be produced by a known method such as a suspension polymerization method, an interface polymerization method, a surface precipitation method or a drying-in-liquid method. For example, in a suspension polymerization method, a polymerizable monomer, the capsuled substance and a polymerization initiator are mixed, and the mixture is dispersed in an aqueous medium containing a surfactant and a dispersion stabilizer to perform suspension polymerization. A compound having a group reactive with the functional group of the polymerizable monomer or an organic filler may also be added.

Examples of the polymerizable monomer include the following: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, vinyl acetate, acrylic acid esters (such as methyl acrylate, ethyl acrylate, n-butyl acrylate, isobutyl acrylate, t-butyl acrylate, isobornyl acrylate, cyclohexyl acrylate and benzyl acrylate), methacrylic acid esters (such as methyl methacrylate, ethyl methacrylate, n-butyl methacrylate, isobutyl methacrylate, t-butyl methacrylate, isobornyl methacrylate, cyclohexyl methacrylate and benzyl methacrylate), styrene monomers, acrylamides, substituted acrylamides, methacrylamide, substituted methacrylamides, butadiene, ε-caprolactam, polyethers and isocyanates. These polymerizable monomers can be used singly or in combinations of two or more.

The polymerization initiator for use can be known peroxide initiators and azo initiators. Examples of the peroxide initiators include dicumyl peroxide. Specific examples of the azo initiators include the following: 2,2'-azobisisobutyronitrile, 1,1'-azobiscyclohexane-1-carbonitrile, 2,2'-azobis-4-methoxy-2,4-dimethylvaleronitrile and 2,2'-azobis-2,4-dimethylvaleronitrile. Among these azo initiators, 2,2'-azobisisobutyronitrile can be used. In use of the polymerization initiator, 0.01 to 5 parts by mass of the polymerization initiator can be added to 100 parts by mass of the polymerizable monomer.

The surfactant for use can be anionic surfactants, cationic surfactants, nonionic surfactants, amphoteric surfactants and high-molecular dispersants. In use of the surfactant, 0.01 to 10 parts by mass of the surfactant can be added to 100 parts by mass of the polymerizable monomer. Examples of the dispersion stabilizer include organic fine particles (such as polystyrene fine particles, poly(methyl methacrylate) fine particles, polyacrylate fine particles and polyepoxide fine particles), silica (such as colloidal silica), calcium carbonate, calcium phosphate, aluminum hydroxide, barium carbonate and magnesium hydroxide. In use of the dispersion stabilizer, 0.01 to 20 parts by mass of the dispersion stabilizer can be added to 100 parts by mass of the polymerizable monomer.

Suspension polymerization can be performed with a pressure-resistant container under sealing. A suspension may be prepared in a dispersing machine, and be placed in a pressure-resistant container to perform suspension polymerization; or a suspension may be prepared in the pressure-resistant container. The polymerization temperature can be 50° C. to 120° C. Polymerization may be performed under atmospheric pressure. Polymerization may be performed under increased pressure (under a pressure of atmospheric pressure plus 0.1 to 1 MPa) so as not to vaporize the capsuled substance. After completion of polymerization, solid liquid separation and washing may be performed through centrifugation or filtration. After solid liquid separation and washing are performed, the product may be dried or pulverized at a temperature equal to or lower than the softening temperature of the resin forming the heat-expansible microcapsule. Drying and pulverization can be performed by a known method using an air stream dryer, a fair wind dryer and a Nauta Mixer, for example. Drying and pulverization can be simultaneously performed with a crushing dryer. The surfactant and the dispersion stabilizer can be removed through repeated washing and filtration after production.

(Second Method)

Examples of the second method include a method of forming a plurality of depressions on the surface of the electroconductive elastic layer, and pouring a liquid electrically insulating material into the depressions, and a method of applying an electrically insulating material onto the electroconductive elastic layer in the form of dots by screen printing or using a jet dispenser to form electrically insulating domains. Examples of the electrically insulating material include urethane resins, acrylic resins, polyethylene resins, polypropylene resins, polyester resins, fluorinated resins and epoxy resins.

In application of the electrically insulating material in the form of dots by screen printing or using a jet dispenser, any coating material having a volume resistivity after drying of $1.0\times10^{13}$ Ω·cm or more can be used. Any coating material containing a thermoplastic resin, a thermosetting resin or an ultraviolet light curable resin can be used. Examples thereof include urethane resin coating materials, acrylic resin coating materials, polyethylene resin coating materials, polypropylene resin coating materials, polyester resin coating materials, fluorinated resin coating materials and epoxy resin coating materials. These coating materials can be diluted with a solvent to be applied. Any known solvent can be used. Specifically, examples thereof include ketones such as methyl ethyl ketone and methyl isobutyl ketone; hydrocarbons such as hexane and toluene; alcohols such as methanol and isopropanol; esters; and water.

[Surface Layer]

The surface layer contains a polymetalloxane having a structure represented by Structural Formula (a1); and a metal atom M1 in Structural Formula (a1) and a carbon atom in a structural unit represented by Structural Formula (a2) are bonded through a linking group represented by Structural Formula (a3).

Structural Formula (a1)

$$M1O_{(k-(s+1))/2}(L1)_s$$

Structural Formula (a2)

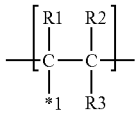

Structural Formula (a3)

In Structural Formula (a1),

M1 represents a metal atom selected from the group consisting of Ti, Zr, Hf, V, Nb, Ta, W, Al, Ga, In and Ge;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5;

s represents an integer of 0 or more and (k−2) or less; and

L1 represents a ligand having a structure represented by Formula (b) or a ligand having a structure represented by Formula (c).

In Structural Formula (a2), R1 to R3 each independently represent a hydrogen atom or an alkyl group having 1 to 3 carbon atoms; and a symbol "*1" represents a site of bonding to Z in Structural Formula (a3); and in Structural Formula (a3), Z represents a substituted or unsubstituted phenylene group, provided that the substituent in the substituted phenylene group is a halogen atom or an alkyl group having 1 to 3 carbon atoms; a symbol "*1" represents a site of bonding to the symbol "*1" in Structural Formula (a2); and a symbol "*2" represents a site of bonding to M1 in Structural Formula (a1).

The polymetalloxane has a metalloxane structure in which the metal atom M1 and an oxygen atom are bonded. Herein, M1 is a metal atom selected from the group consisting of titanium (Ti), zirconium (Zr), hafnium (Hf), vanadium (V), niobium (Nb), tantalum (Ta), tungsten (W), aluminum (Al), gallium (Ga), indium (In) and germanium (Ge).

M1 is preferably titanium, tantalum and aluminum, more preferably titanium from the viewpoint of the stability of the metal complex.

For example, in the case that M1 is Ti and s=0 in Structural Formula (a1), a metalloxane structure represented by $TiO_{3/2}$ is present in the polymetalloxane according to the present invention. Ti in the metalloxane structure bonds to the carbon atom in a structural unit represented by Structural Formula (a2) through a linking group represented by Structural Formula (a3).

In the case that M1 is Ti and s=1, a metalloxane structure represented by $TiO_{2/2}(L1)_1$ is present in the polymetalloxane. Ti in the metalloxane structure is coordinated with L1 or a ligand (b) or (c) described later, and bonds to the carbon atom in a structural unit represented by Structural Formula (a2) through a linking group represented by Structural Formula (a3).

s is preferably an integer of 1 or more and (k−2) or less because flexibility is attained through bonding to the structure represented by Structural Formula (a2), and a shallower HOMO is achieved to further enhance the ability to prevent abnormal discharge. s is more preferably 1 or 2.

The polymetalloxane may further include a structure represented by Structural Formula (a4). A polymetalloxane including such a structure can control the characteristics of the surface layer. Examples of the controllable characteristics of the surface layer include smoothness and strength.

$$M1O_{(k-t)/2}(L1)_t \qquad \text{Structural Formula (a4)}$$

In Structural Formula (a4), M1, L1 and k are each defined as M1, L1 and k in Structural Formula (a1). t is an integer of 0 or more and (k−1) or less.

For example, in the case that M1 is Ti and t=0 in Structural Formula (a4), the polymetalloxane according to the present invention further contains $TiO_{4/2}$. In the case that M1 is Ti and t=1, the polymetalloxane according to the present invention further contains $TiO_{3/2}(L1)_1$.

The presence of the metal atom M1 in the polymetalloxane can be verified with an energy dispersion X-ray spectrometer (EDAX), for example. The presence of the metalloxane structure can be verified by a variety of nuclear magnetic resonance (NMR) analyses. Furthermore, it can be verified by solid NMR analysis that M1 in Structural Formula (a1) bonds to the carbon atom in a structural unit represented by Structural Formula (a2) through a linking group represented by Structural Formula (a3). Specifically, this bonding can be verified from a chemical shift of the peak attributed to the carbon atom bonding to the hydroxyl group in a phenylene group of polyvinylphenol toward the low magnetic field. Details of the analysis method and analysis conditions will be described in Examples.

The ligand having a structure represented by Formula (b) and the ligand having a structure represented by Formula (c) according to L1 in Structural Formula (a1) will now be described.

(Ligand Having Structure Represented by Formula (b))

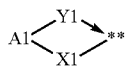

(b)

In Formula (b), X1 represents a structure represented by one of Formulae (1) to (4); Y1 represents a group having a site of coordination with M1 in Structural Formula (a1); A1 represents a direct bond or an atomic group needed to form a 4- to 8-membered ring with M1, X1 and Y1; and a symbol "**" represents a site of bonding to or coordination with M1.

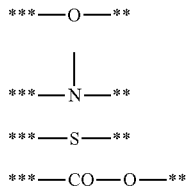

(1)
(2)
(3)
(4)

In Formulae (1) to (4), a symbol "" represents a site of bonding to the metal atom M1 in Structural Formula (a1); and a symbol "*" represents a site of bonding to A1 in Formula (b).

The nitrogen atom in Formula (2) may be a nitrogen atom in a heterocyclic skeleton such as a pyrrole skeleton, an indole skeleton, a pyrrolidine skeleton, a carbazole skeleton, an imidazole skeleton, a benzimidazole skeleton, a pyrazole skeleton, an indazole skeleton, a triazole skeleton, a benzotriazole skeleton, a tetrazole skeleton, a pyrrolidone skeleton, a piperidine skeleton, a morpholine skeleton and a piperazine skeleton.

Formula (2) illustrates the nitrogen atom directly bonded to A1. In the case that the nitrogen atom is a nitrogen atom in the heterocycle skeleton, the heterocycle skeleton having a nitrogen atom has a site of bonding to A1 (site having the symbol "***") as illustrated in Formula (2c) described later.

The heterocycle skeleton may have a substituent. Examples of the substituent include linear or branched alkyl groups having 1 to 10 carbon atoms, or linear or branched alkoxy groups having 1 to 10 carbon atoms. Among these substituents, linear or branched alkyl groups having 1 to 4 carbon atoms, or linear or branched alkoxy groups having 1 to 4 carbon atoms can be used (the same is true of the substituents described later unless otherwise specified).

In the case that the nitrogen atom in Formula (2) is not the nitrogen atom in the heterocycle skeleton, examples of an atom or a group other than A1 and M1 bonding to the nitrogen atom (atom or a group bonding to the site of bonding to the nitrogen atom having no symbol "" or "*" in Formula (2)) include hydrogen atoms, substituted or unsubstituted aryl groups, or substituted or unsubstituted alkyl groups having 1 to 10 carbon atoms. Specifically, examples thereof include hydrogen atoms; aryl groups such as a phenyl group and a naphthyl group; linear alkyl groups such as a methyl group, an ethyl group, a n-propyl group, a n-butyl group, a n-hexyl group, a n-octyl group, a n-nonyl group and a n-decyl group; branched alkyl groups such as an isopropyl group and a t-butyl group; and cyclic alkyl groups such as a cyclopentyl group and a cyclohexyl group.

The group represented by Formula (2) can be an unsubstituted amino group, a monoalkylamino group having 1 to 4 carbon atoms, or a divalent group having a pyrrole skeleton from which one of hydrogen atoms bonding to the nitrogen atom is removed.

In Formula (b), Y1 is a group having a site of coordination with M1 in Structural Formula (a1) and including an atom having an unshared electron pair. Specifically, examples thereof include a hydroxy group, an alkoxy group, a substituted or unsubstituted aryloxy group, a carbonyl group, a thiol group, an alkyl thio group, a substituted or unsubstituted arylthio group, a thiocarbonyl group, a substituted or unsubstituted amino group, and a substituted or unsubstituted imino group.

Examples of the alkoxy group include linear or branched alkoxy groups having 1 to 10 carbon atoms. Specifically, examples thereof include a methoxy group, an ethoxy group, a n-propoxy group, an isopropoxy group, a n-butoxy group and a t-butoxy group. The alkoxy group can be a linear or branched alkoxy group having 1 to 4 carbon atoms.

Examples of the aryloxy group include a phenoxy group and a naphthyloxy group. These groups may have substituents.

Examples of the alkylthio group include alkoxy groups in which an oxygen atom is replaced with a sulfur atom.

Examples of the arylthio group include aryloxy groups in which an oxygen atom is replaced with a sulfur atom. These groups may have substituents.

Examples of the carbonyl group include a formyl group, a carboxyl group, an alkylcarbonyl group, an alkoxycarbonyl group, an arylcarbonyl group, an amide group (R—CO—NR— or R—NR—CO—), a ureido group ($NH_2$—CO—NH—) and a urea group (R—NH—CO—NH—). It is preferred that in the alkyl group of the alkylcarbonyl group and the alkoxycarbonyl group, the amide group, and the urea group, R each independently represents a hydrogen atom, or a linear or branched alkyl group having 1 to 10 carbon atoms. Specifically, examples thereof include linear alkyl groups such as a methyl group, an ethyl group, a n-propyl group, a n-butyl group, a n-hexyl group, a n-octyl group, a n-nonyl group and a n-decyl group; and branched alkyl groups such as an isopropyl group and a t-butyl. Among these groups, linear or branched alkyl groups having 1 to 4 carbon atoms can be used.

The alkylcarbonyl group may be a group, such as a benzylcarbonyl group, in which an aryl group such as a phenyl group is further substituted.

Examples of the arylcarbonyl group include groups having substituted or unsubstituted aromatic hydrocarbons bonded with a carbonyl group, or groups having substituted or unsubstituted aromatic heterocycles bonded with a carbonyl group. Specifically, examples thereof include substituted or unsubstituted phenylcarbonyl and naphthylcarbonyl groups.

Examples of the thiocarbonyl group include groups in which an oxygen atom of the carbonyl group is replaced with a sulfur atom.

Examples of the substituted amino group include an alkylamino group, a dialkylamino group, and a substituted or unsubstituted arylamino group. Specifically, examples thereof include monoalkylamino groups having 1 to 10 carbon atoms such as a monomethylamino group and a monoethylamino group; dialkylamino groups having 1 to 10 carbon atoms such as dimethylamino group, a diethylamino group and a methylethylamino group; and substituted or unsubstituted arylamino groups having 1 to 10 carbon atoms such as a monophenylamino group, a methylphenylamino group, a diphenylamino group and a naphthylamino group.

The unsubstituted imino group is a group represented by >C═NH or N═$CH_2$. The hydrogen atom of the unsubstituted imino group may be replaced with an alkyl group having 1 to 10 carbon atoms or a substituted or unsubstituted aryl group (phenyl group, naphthyl group).

Y1 may be a group having a substituted or unsubstituted aliphatic heterocyclic skeleton, or a group having a substituted or unsubstituted aromatic heterocyclic skeleton. Examples of the aliphatic heterocyclic skeleton include a morpholine skeleton. Examples of aromatic heterocyclic skeletons include a thiophene skeleton, a furan skeleton, a pyrrole skeleton, a pyridine skeleton, a pyran skeleton, a benzothiophene skeleton, a benzofuran skeleton, a quinoline skeleton, an isoquinoline skeleton, an oxazole skeleton, a benzoxazole skeleton, a thiazole skeleton, a benzothiazole skeleton, a thiadiazole skeleton, a benzothiadiazole skeleton, a pyridazin skeleton, a pyrimidine skeleton, a pyrazine skeleton, a phenazine skeleton, an acridine skeleton, a xanthene skeleton, an imidazole skeleton, a benzimidazole skeleton, a pyrazole skeleton, an indazole skeleton, a triazole skeleton, a benzotriazole skeleton and a tetrazole skeleton. These skeletons may have substituents.

Among these exemplified groups, Y1 is preferably a hydroxy group, an alkoxy group having 1 to 4 carbon atoms, a substituted or unsubstituted phenoxy group, a substituted or unsubstituted naphthyloxy group, a formyl group, an alkylcarbonyl group having an alkyl group having 1 to 4 carbon atoms, an alkoxycarbonyl group having an alkoxy group having 1 to 4 carbon atoms, a thiocarbonyl group, a dimethylamide group, a diethylamide group, an ethylmethylamide group, an unsubstituted amino group, a monomethylamino group, a monoethylamino group, a dimethylamino group, a diethylamino group, a monophenylamino group, a methylethylamino group, a methylphenylamino group, a diphenylamino group, a naphthylamino group, an unsubstituted imino group, a methanimino group, an ethanimino group, a group having a pyridine skeleton, a group having a quinoline skeleton, or a group having an isoquinoline skeleton.

In Formula (b), A1 represents a direct bond or an atomic group needed to form a 4- to 8-membered ring with M1, X1 and Y1. The direct bond specifically represents a single bond or a double bond. In the case that A1 is a direct bond, X1 directly bonds to Y1 through a single bond or a double bond. The direct bond can be a single bond.

In the case that A1 is an atomic group needed to form a 4- to 8-membered ring with M1, X1 and Y1, examples of the atomic group include the followings: substituted or unsubstituted alkylene groups such as a methylene group, an ethylene group, a trimethylene group and a tetramethylene group; substituted or unsubstituted alkenylene groups such as a vinylene group, a propenylene group, a butenylene group and a pentenylene group; and atomic groups having a substituted or unsubstituted aromatic ring (a benzene ring, a naphthalene ring, a pyrrole ring, a thiophene ring, a furan ring, a pyridine ring, an indole ring, a benzothiophene ring, a benzofuran ring, a quinoline ring and an isoquinoline ring). Examples of the substituent in the alkenylene group include alkyl groups having 1 to 4 carbon atoms, alkoxy groups having 1 to 4 carbon atoms, a phenyl group or a benzyl group.

A1 is preferably a single bond, an alkylene group, or an atomic group having a substituted or unsubstituted aromatic ring (a benzene ring, a naphthalene ring, a pyrrole ring, a thiophene ring, a furan ring, a pyridine ring, an indole ring, a benzothiophene ring, a benzofuran ring, a quinoline ring and an isoquinoline ring), and is more preferably a single bond, an alkylene group, or an atomic group having a substituted or unsubstituted aromatic ring (a benzene ring, a naphthalene ring, a pyrrole ring, a pyridine ring, an indole ring, a quinoline ring and an isoquinoline ring). In the case that A1 is a direct bond or an atomic group, the structure represented by Formula (b) has higher stability and a higher effect of preventing abnormal discharge compared to the case where A1 is an alkenylene group.

In the case that A1 is an atomic group having an aromatic ring, A1 may form a condensation ring with one or both of an aromatic heterocycle of Y1 and an aromatic heterocycle of X1.

The ring formed with A1, M1, X1 and Y1 can be a 5-membered ring or a 6-membered ring because a complex is readily formed.

Specific preferred examples of a ligand represented by Formula (b) include the following.

In the case that X1 is a structure represented by Formula (1), the ligand represented by Formula (b) is preferably a structure represented by one of Formulae (5) to (9):

(5)

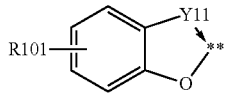

(6)

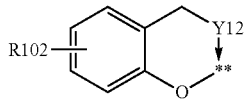

(7)

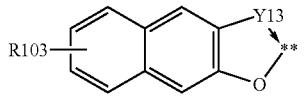

(8)

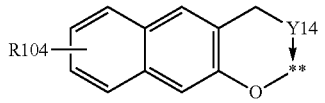

where in Formulae (5) to (8), R101 to R104 are each independently a hydrogen atom, a methoxy group or an ethoxy group; Y11 to Y14 each independently represent a methoxy group, an ethoxy group, a formyl group, a methylcarbonyl group, an ethylcarbonyl group, a methoxycarbonyl group, an ethoxycarbonyl group, a dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methanimino group, an ethanimino group, a group having a pyridine skeleton, a group having a quinoline skeleton, or a group having an isoquinoline skeleton; and a symbol "**" represents a site of bonding to the metal atom M1 in Structural Formula (a1);

(9)

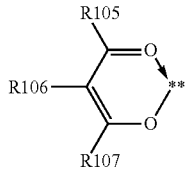

where in Formula (9), R105 is an alkyl group having 1 to 4 carbon atoms, a phenyl group, or a benzyl group; R106 is a hydrogen atom, or an alkyl group having 1 to 4 carbon atoms; R107 is an alkyl group having 1 to 4 carbon atoms, an alkoxy group having 1 to 4 carbon atoms, a phenyl group, or a benzyl group; and a symbol "**" represents a site of bonding to the metal atom M1 in Structural Formula (a1).

In the case that X1 is a structure represented by one of Formulae (2) to (4), a preferred combination of X1, A1 and Y1 is as follows.

A1 is a single bond, a methylene group, an ethylene group or a trimethylene group; X1 is a structure represented by one of Formulae (2a) to (2c) (these are structures contained in Formula (2)), (3) and (4); and Y1 is a methoxy group, an ethoxy group, a formyl group, a methylcarbonyl group, an ethylcarbonyl group, a methoxycarbonyl group, an ethoxycarbonyl group, a dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methanimino group, an ethanimino group, a group having a pyridine skeleton, a group having a quinoline skeleton, or a group having an isoquinoline skeleton.

(2a)

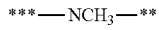

(2b)

(2c)

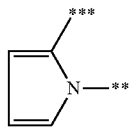

(3)

(4)

In Formulae (2a) to (2c), (3) and (4), a symbol "" represents a site of bonding to the metal atom M1 in Structural Formula (a1); and a symbol "*" represents a site of bonding to A1 in Formula (b).

Among the compounds that can form a ligand L1 in Structural Formula (a1) (hereinafter, referred to as "compound for a ligand"), specific examples of the compound for a ligand represented by Formula (b) are shown in FIGS. 7-10.

Some of the compounds for a ligand shown in FIGS. 7-10 will be specifically described.

Examples of a compound for a ligand represented by Formula (4) as X1 in Formula (b) include o-anisic acid represented by Formula (101):

(101)

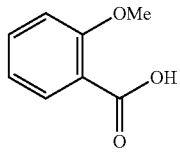

o-Anisic acid forms a complex as follows: The hydrogen atom of the carboxyl group is removed, the oxygen atom bonds to the metal atom M1, and the oxygen atom of the methoxy group (Y1) bonds to the metal atom M1 through coordination bond. The residual 1,2-phenylene group corresponds to A1. It is believed that if o-anisic acid is mixed with titanium isopropoxide in a molar ratio of 2:1 and poly(vinylphenol) is further mixed, a structure represented by Formula (102) is formed, for example:

(102)

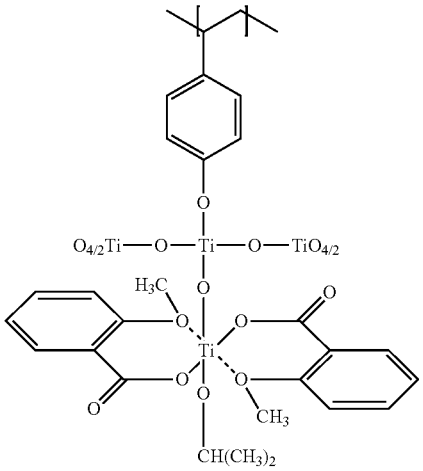

Examples of a compound for a ligand represented by Formula (1) as X1 include 4-hydroxy-5-azaphenanthrene represented by Formula (103):

(103)

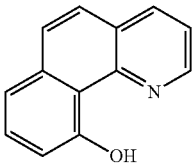

4-Hydroxy-5-azaphenanthrene forms a complex as follows: The hydrogen atom of the hydroxy group is removed, the oxygen atom bonds to the metal atom M1, and the nitrogen atom in the pyridine skeleton (Y1) bonds to the metal atom M1 through coordination bond. The naphthalene skeleton corresponds to A1. The pyridine skeleton and the naphthalene skeleton are condensed into an azaphenanthrene skeleton.

Examples of the compound for a ligand represented by Formula (2) as X1 include 2-acetylpyrrole represented by Formula (104):

(104)

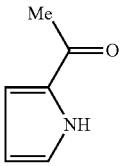

2-Acetylpyrrole forms a complex as follows: The nitrogen atom in the pyrrole skeleton bonds to the metal atom M1, and the oxygen atom in the methylcarbonyl group (Y1) bonds to the metal atom M1 through coordination bond. The single bond connecting the methylcarbonyl group to the pyrrole skeleton corresponds to A1.

Other examples of the compound for a ligand include a compound for a ligand represented by Formula (9). The following compounds are not illustrated in Tables 1 to 4. β-Diketones such as acetylacetone, 3-ethyl-2,4-pentanedione, 3,5-heptanedione, 2,2,6,6-tetramethyl-3,5-heptanedione, 2,6-dimethyl-3,5-heptanedione, 6-methyl-2,4-heptanedione, 1-phenyl-1,3-butanedione, 3-phenyl-2,4-pentanedione and 1,3-diphenyl-1,3-propanedione; and β-keto esters such as methyl acetoacetate, methyl 3-oxopentanoate, methyl 4-oxohexanoate, methyl isobutyryl acetate, methyl 4,4-dimethyl-3-oxovalerate, ethyl acetoacetate, tert-butyl acetoacetate, isopropyl acetoacetate, butyl acetoacetate and benzyl acetoacetate.

Among these compounds, for example, in acetylacetone represented by Formula (105), the oxygen atom in the hydroxy group of the enol form corresponds to X1, the methylcarbonyl group Y1, and the residue A1.

(105)

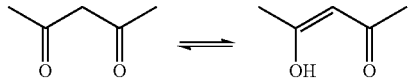

It is believed that if acetylacetone is mixed with titanium isopropoxide in a molar ratio of 2:1 and poly(vinylphenol) is further mixed, a structure represented by Formula (106) is formed.

(106)

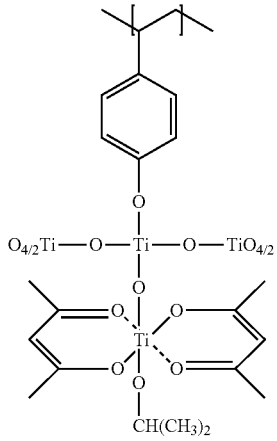

(Ligand Having Structure Represented by Formula (c))

(c)

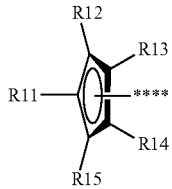

In Formula (c), R11 to R15 each independently represent a hydrogen atom, an alkyl group having 1 to 4 carbon atoms, or a trimethylsilyl group. To provide a sallower highest occupied molecular orbital (HOMO) of the polymetalloxane, at least one of R11 to R15 may preferably be an electron donating group. Namely, at least one of R11 to R15 may preferably be a methyl group, a t-butyl group or a trimethylsilyl group. A symbol "****" represents a site of coordination with the metal atom M1 in Structural Formula (a1). Specific examples of the structure represented by Formula (c) are shown in Table 5. In the structures shown in Table 5, "Me" represents a methyl group.

TABLE 5

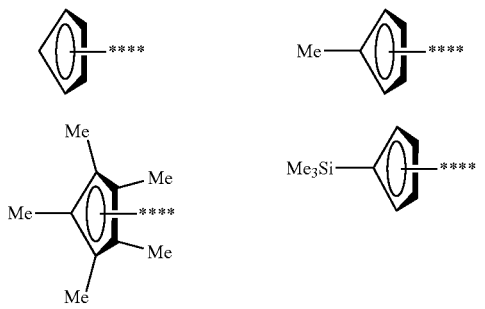

In the structures represented by Formula (b) and Formula (c), the number of ligands L1 coordinated per metal atom (M1) is not limited to one. Not only one ligand but also two or more ligands may be coordinated with the metal atom M1.

The polymetalloxane is prepared through a reaction of a polymer including a structural unit having a phenolic hydroxyl group with a compound having a structure represented by Formula (d).

Namely, the polymetalloxane can be defined as a reaction product of a polymer including a structural unit having a phenolic hydroxyl group with a metal alkoxide having a structure represented by Formula (d). Herein, the polymer including a structural unit having a phenolic hydroxyl group is a polymer including a structural unit having a structure represented by Structural Formula (a2) through a structure represented by Structural Formula (a3).

The difference between the surface layer and the surface layer containing a binder resin containing particulate titanium oxide is that a crystal structure, which is observed if particulate titanium oxide is present, is not observed in the surface layer according to the present invention. Namely, according to the present invention, the reaction product of the polymer including a structural unit having a phenolic hydroxyl group with the compound having a structure represented by Formula (d) is in an amorphous state. That the reaction product is in an amorphous state can be verified by crystal structure analysis with an X-ray diffraction apparatus (XRD), for example. Details of the analysis method and analysis conditions will be described in Examples.

Examples of the polymer including a structural unit having a phenolic hydroxyl group include polymers containing vinylphenol such as poly(vinylphenol) (such as (poly(hydroxystyrene)) as a structural unit, and novolak phenol resins.

$$M2(OR21)_{q-p}(L2)_p \quad (d)$$

In Formula (d), M2 is the same as M1 in Structural Formula (a1), and represents a metal atom selected from the group consisting of Ti, Zr, Hf, V, Nb, Ta, W, Al, Ga, In and Ge. R21 represents a hydrocarbon group having 1 to 10 carbon atoms. R21 can be a hydrocarbon group having 1 to 4 carbon atoms.

p represents an integer of 0 or more and q or less, where (q−p) is 2 or more. For q, in the case that M2 is Al, Ga or In, then q=3; in the case that M2 is Ti, Zr, Hf or Ge, then q=4; in the case that M2 is Nb, Ta or W, then q=5; and in the case that M2 is V, then q=3 or 5. p can be an integer of 1 or more and q or less, presuming that (q−p) is 2 or more. Namely, a metal atom M1 bonded to or coordinated with the ligand (b) or (c) should be present in the polymetalloxane according to the present invention prepared with a metal alkoxide where p is 1 or more.

Because such a polymetalloxane can have a shallower HOMO, a charging member which can further prevent generation of abnormal discharge is achieved. p is more preferably 1 or 2.

L2 represents a ligand having a structure represented by Formula (e) or a ligand having a structure represented by Formula (f). In the case that p is 2 or more, a plurality of L2 may be different from each other.

(c)

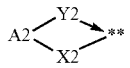

In Formula (e), a symbol "**" represents a site of bonding to or coordination with the metal atom M2 in the Formula (d), which is eventually the metal atom M1 in the polymetalloxane. A2 and Y2 are the same as A1 and Y1 described above, respectively. X2 represents one of structures represented by Formulae (10) to (13):

(10)

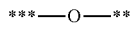

(11)

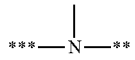

(12)

(13)

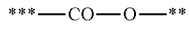

In Formulae (10) to (13), a symbol "" represents a site of bonding to the metal atom M2 in Formula (d); and a symbol "*" represents a site of bonding to A2 in Formula (e). Specific examples of the structures represented by Formulae (10) to (13) include the same structures as those described in Formulae (1) to (4).

(f)

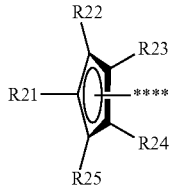

In Formula (f), R21 to R25 are the same as R11 to R15 described in Formula (c) above. A symbol "****" represents a site of coordination with the metal atom M2 in Formula (d).

For example, the polymetalloxane represented by Structural Formula (a4) and further having a structure where t is "k−1" in Structural Formula (a4) can be prepared through coexistence of a compound represented by Formula (d') in a reaction system containing the polymer including a structural unit having a phenolic hydroxyl group.

$$M2(OR21)_{q-p'}(L2)_{p'} \quad (d')$$

In Formula (d'), M2, R21, L2 and q are the same as M2, R21, L2 and q in the formula (d), and p' represents an integer represented by (q−1).

(Formation of Surface Layer)

The surface layer is formed through the following steps (i) to (iii), for example:

(i) a step of preparing a coating liquid for forming a surface layer, (ii) a step of forming a coating of the coating liquid, and (iii) a step of drying the coating.

The steps will now be described.

(i) Step of preparing coating liquid for forming surface layer

The coating liquid can be prepared through Step 1 and Step 2 below, for example.

[Step 1]

Step 1 is a step of preparing a solution of a raw material for a coating liquid. Specifically, a solution of the polymer including a structural unit having a phenolic hydroxyl group (hereinafter, referred to as "polymer solution") is prepared. A solution of the compound represented by Formula (d) (hereinafter, referred to as "metal alkoxide solution") is also prepared.

Here, use of a compound where p is 1 or more in Formula (d), that is, a compound where the metal atom M2 is coordinated with the ligand L2 will be described. In this case, for example, a metal alkoxide solution as a raw material having no coordinated ligand L2 and a solution (hereinafter, also referred to as "solution of compound for a ligand") of a raw material for the ligand L2 (hereinafter, also referred to as "compound for a ligand") can be each prepared, and mixed to prepare a metal alkoxide solution (hereinafter, also referred to as "metal complex solution") of a compound represented by Formula (d) where the metal atom M2 is coordinated with the ligand L2. In this case, the compound for a ligand is added in an amount of preferably 0.5 mol or more, more preferably 1 mol or more relative to 1 mol of the metal alkoxide as a raw material. A combination of two or more compounds for a ligand and two or more metal alkoxides may also be used. Furthermore, in the structures represented by Formulae (e) and (f), the number of ligands L2 coordinated per metal atom is not limited to one. The metal atom M2 may be coordinated with not only a single ligand but also two or more ligands. If available, a metal alkoxide having a compound for a ligand coordinated can also be purchased, and can be used as it is as a metal complex solution.

In the case that a compound where p is 0 in Formula (d) is used, the compound matches with the metal alkoxide as a raw material. Accordingly, the solution of the metal alkoxide as a raw material is the metal alkoxide solution.

Examples of the metal alkoxide usable as a raw material where M2 is not coordinated with L2 include alkoxides of titanium, zirconium, hafnium, vanadium, niobium, tantalum, tungsten, aluminum, gallium, indium and germanium. Examples of alkoxides include alkoxides having to 10 carbon atoms such as methoxide, ethoxide, n-propoxide, isopropoxide, n-butoxide, 2-butoxide and t-butoxide. Among these alkoxides, alkoxides having 1 to 4 carbon atoms can be used.

[Step 2]

Step 2 is a step of mixing the polymer solution and the metal alkoxide solution (or metal complex solution) prepared in Step 1 to prepare a coating liquid. In Step 2, during mixing of the polymer solution with the metal alkoxide solution, the compound represented by Formula (d) is added in an amount of preferably 0.01 mol or more, more preferably 0.1 mol or more relative to 1 mol of the polymer including a structural unit having a phenolic hydroxyl group in the polymer solution.

In the case that a structure represented by Structural Formula (a4) is introduced into the polymetalloxane to reform the surface layer, alkoxysilane may be added to the coating liquid, for example. Examples of the alkoxysilane include tetraalkoxysilane, trialkoxysilane and dialkoxysilane.

Specific examples of the tetraalkoxysilane include tetramethoxysilane, tetraethoxysilane, tetra(n-propoxy)silane, tetra(isopropoxy)silane, tetra(n-butoxy)silane, tetra(2-butoxy)silane and tetra(t-butoxy)silane.

Examples of the trialkoxysilane include trimethoxysilanes and triethoxysilanes.

Specific examples of the trimethoxysilanes include trimethoxyhydrosilane, trimethoxymethylsilane, trimethoxyethylsilane, trimethoxy(n-propyl)silane, trimethoxy(isopropoxy)silane, trimethoxy(n-butoxy)silane, trimethoxy(2-butoxy)silane, trimethoxy(t-butoxy)silane, trimethoxy(n-hexyl)silane, trimethoxy(n-octyl)silane, trimethoxy(n-decyl)silane, trimethoxy(n-dodecyl)silane, trimethoxy(n-tetradecyl)silane, trimethoxy(n-pentadecyl)silane, trimethoxy(n-hexadecyl)silane, trimethoxy(n-octadecyl)silane, trimethoxycyclohexylsilane, trimethoxyphenylsilane and trimethoxy(3-glycidylpropyl)silane.

Specific examples of the triethoxysilanes include triethoxyhydrosilane, triethoxymethylsilane, triethoxyethylsilane, triethoxy(n-propyl)silane, triethoxy(isopropoxy)silane, triethoxy(n-butoxy)silane, triethoxy(2-butoxy)silane, triethoxy(t-butoxy)silane, triethoxy(n-hexyl)silane, triethoxy(n-octyl)silane, triethoxy(n-decyl)silane, triethoxy(n-dodecyl)silane, triethoxy(n-tetradecyl)silane, triethoxy(n-pentadecyl)silane, triethoxy(n-hexadecyl)silane, triethoxy(n-octadecyl)silane, triethoxycyclohexylsilane, triethoxyphenylsilane and triethoxy(3-glycidylpropyl)silane.

Examples of the dialkoxysilanes include dimethoxysilanes and diethoxysilanes. Specific examples of the dimethoxysilanes include dimethoxydimethylsilane, dimethoxydiethylsilane, dimethoxymethylphenylsilane, dimethoxydiphenylsilane and dimethoxy(bis-3-glycidylpropyl)silane. Specific examples of the dimethoxysilanes include diethoxydimethylsilane, diethoxydiethylsilane, diethoxymethylphenylsilane, diethoxydiphenylsilane and diethoxy(bis-3-glycidylpropyl)silane.

Any solvent which can dissolve the metal alkoxide and the polymer including a structural unit having a phenolic hydroxyl group can be used as an organic solvent in preparation of the coating liquid. For example, alcohol solvents, ether solvents, cellosolve solvents, ketone solvents and ester solvents can be used. Specifically, examples of the alcohol solvents include methanol, ethanol, n-propanol, isopropanol, 1-butanol, 2-butanol, t-butanol, 1-pentanol and cyclohexanol. Specifically, examples of the ether solvents include dimethoxyethane. Specifically, examples of the cellosolve solvents include methyl cellosolve and ethyl cellosolve. Examples of the ketone solvents specifically include acetone, methyl ethyl ketone and methyl isobutyl ketone. Examples of the ester solvents specifically include methyl acetate and ethyl acetate. These organic solvents may be used singly or in the form of a mixture thereof.

(ii) Step of Forming Coating of Coating Liquid

The coating of the coating liquid prepared in Step (i) can be formed by any method selected from methods usually used. Specifically, examples thereof include coating with a roll coater, immersion coating, and ring coating.

(iii) Step of Drying Coating

The coating of the coating liquid is dried to form the surface layer according to the present invention. The coating may be dried by heating.

In Step 2 of step (i) to step (iii), the compound represented by Formula (d) in the coating liquid is fed to the two reactions below.

- a reaction in which the alkoxy groups in the compound represented by Formula (d) are hydrolyzed into hydroxyl groups, and the generated hydroxyl groups are condensed to form a metalloxane bond.
- a reaction in which the metal atom M2 in the compound represented by Formula (d) reacts with the phenolic hydroxyl group in the polymer to bond to the polymer through the linking group represented by Structural Formula (a3).

As a result, a surface layer containing the polymetalloxane according to the present aspect is formed. Hydrolysis of the compound represented by Formula (d) is promoted by a slight amount of water contained in the organic solvent used in preparation of the coating liquid or water in the air taken into the coating liquid or the coating. The degrees of hydrolysis and condensation may be controlled through addition of water to the coating liquid. The interaction between the polymer including a structural unit having a phenolic hydroxyl group and the metal alkoxide can be verified by solid NMR analysis.

The surface of the coating during the drying step or the surface of the surface layer after drying may be treated to control surface physical properties such as the friction coefficient of the surface of the surface layer and surface free energy. Examples of such a treatment include a method of irradiating the surface with active energy beams. Examples of the active energy beams include ultraviolet light, infrared radiations and electron beams. Among these methods, use of ultraviolet light is preferred. The surface can be irradiated with ultraviolet light such that the accumulated amount of light is 5000 mJ/cm$^2$ or more and 10000 mJ/cm$^2$ or less.

The surface layer has a thickness of preferably 0.005 μm to 30 μm, more preferably 0.005 μm to 5 μm.

<Electrophotographic Apparatus and Process Cartridge>

Figure 3:
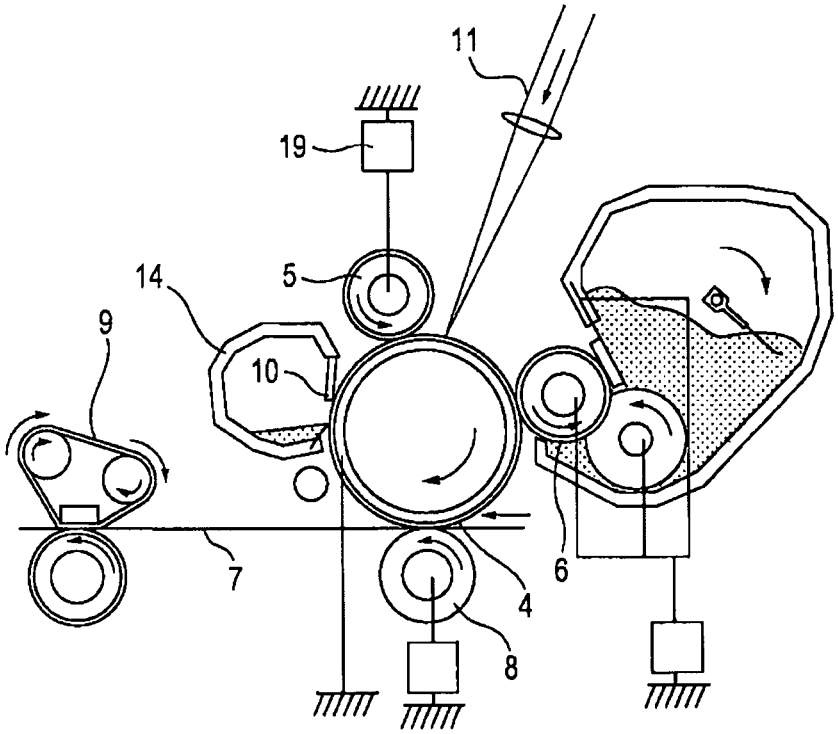
FIG. 3 is a schematic cross-sectional view illustrating one example of the electrophotographic apparatus according to the present invention.
Figure 4:
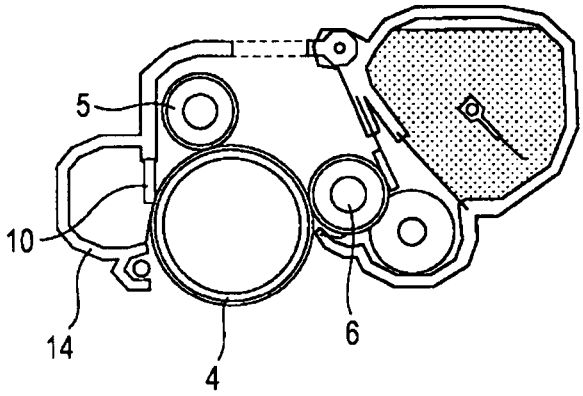
FIG. 4 is a schematic cross-sectional view illustrating one example of the process cartridge according to the present invention.

FIG. 3 illustrates one example of an electrophotographic apparatus including the charging member according to one aspect of the present invention, and FIG. 4 illustrates one example of a process cartridge including the charging member according to the present invention.

A photosensitive member 4 is an image bearing member in the form of a rotary drum. The photosensitive member 4 rotates clockwise indicated by the arrow in FIG. 3 at a predetermined circumferential speed.

A charging member in the form of a roller (charging roller 5) is in contact with the surface of the photosensitive member 4 under a predetermined pressure. The charging roller 5 rotates in the forward direction of the rotation of the photosensitive member 4. A predetermined DC voltage is applied to the charging roller 5 by a charge bias applying power supply 19 (DC charging method). The surface of the photosensitive member 4 is thereby uniformly charged to a predetermined polarity potential (dark portion potential of −500 V in the Examples described later).

The DC voltage applied to the charging roller 5 was −1050 V in the Examples described later. In the next step, the charged surface of the photosensitive member 4 is irradiated with image exposing light 11 corresponding to the target image information from an exposing device not illustrated. As a result, the bright portion potential of the photosensitive member is selectively reduced (decayed) to form an electrostatic latent image on the photosensitive member 4. The bright portion potential of the photosensitive member was −150 V in the Examples described later. The exposing device not illustrated can be any known exposing device such as a laser beam scanner.

A developing roller 6 selectively applies a toner charged to have the same polarity as that of the photosensitive member 4 (negative toner) onto the exposure bright portions of the electrostatic latent image on the surface of the photosensitive member 4 to visualize the electrostatic latent image as a toner image. The developing bias was −400 V in the Examples described later. Any developing method can be used, for example, a jumping developing method, a contact developing method and a magnetic brush method. Among these methods, the contact developing method can be used because the electrophotographic image forming apparatus for outputting color images can effectively reduce scattering of the toner.

A transfer roller 8 is brought into contact with the photosensitive member 4 under a predetermined pressure, and rotates in the forward direction of the rotation of the photosensitive member 4 at substantially the same circumferential speed as the circumferential speed of the rotation of the photosensitive member 4. A transfer voltage having a polarity opposite to that of the charge of the toner is applied from a transfer bias applying power supply. A transfer medium 7 is fed from a sheet feeding mechanism (not illustrated) into the contact portion between the photosensitive member 4 and the transfer roller at a predetermined timing. The rear surface of the transfer medium 7 is charged by the transfer roller 8 at a polarity opposite to the polarity of the charge of the toner to which the transfer voltage is applied. The toner image on the surface of the photosensitive member is electrostatically transferred onto the surface of the transfer medium 7 in the contact portion between the photosensitive member 4 and the transfer roller 8. Any known unit can be used as the transfer roller 8. Specifically, examples thereof include transfer rollers including electroconductive supports made of metals and coated with elastic layers having adjusted middle resistance.

The transfer medium 7 having the transferred toner image is separated from the surface of the photosensitive member, and is introduced into a fixing device 9. The toner image is fixed, and the transfer medium is output as an image formed product. In a double-sided image forming mode or a multiplex image forming mode, this image formed product is introduced into a recirculating transport mechanism (not illustrated) to be reintroduced into a transfer portion. The transfer residual toner left on the photosensitive member 4 is recovered from the photosensitive member 4 by a cleaning device 14 having a cleaning blade 10. If the photosensitive member 4 has the residual charge, the residual charge of the photosensitive member 4 can be removed by a pre-exposing device (not illustrated) after transfer and before primary charge by the charging roller 5. The pre-exposing device is not used in formation of electrophotographic images in the Examples described later.

The process cartridge according to one aspect of the present invention integrally supports at least a photosensitive member and a charging member for charging the surface of the photosensitive member, and is configured to be detachably attachable to the main body of an electrophotographic apparatus. The process cartridge according to one aspect of the present invention includes the charging member according to the present invention as the charging member. The process cartridge used in the Examples described later integrally supports the charging roller 5, the photosensitive member 4, the developing roller 6 and the cleaning device 14 as illustrated in FIG. 4.

One aspect according to the present invention can provide a charging member which has high charging ability, and can prevent generation of strong local discharge (abnormal discharge) even under an environment at a low temperatures and a low humidity. Another embodiment according to the present invention can provide a process cartridge and electrophotographic apparatus which can prevent generation of strong local discharge (abnormal discharge) under an environment at a low temperatures and a low humidity, and can form electrophotographic images with high quality.

EXAMPLES

The present invention will now be described in more detail by way of specific Examples. In the description of the compounds in the Examples, "parts" indicates "parts by mass" unless otherwise specified. Table 6 shows a list of reagents used in the Examples.

TABLE 6

| Symbol | Name | CAS No. | Manufacturer | Notes |
|---|---|---|---|---|
| S1 | 2-Butanol | 78-92-2 | KANTO CHEMICAL CO., INC. | Special grade |
| S2 | Ethanol | 64-17-5 | KISHIDA CHEMICAL Co., Ltd. | Special grade |
| S3 | Methyl isobutyl ketone | 108-10-1 | KISHIDA CHEMICAL Co., Ltd. | First grade |
| S4 | Dimethoxyethane | 110-71-4 | KISHIDA CHEMICAL Co., Ltd. | Special grade |
| S5 | Ion-exchanged water | — | KYOEI PHARMACEUTICAL CO., LTD. | Ion exchange + distillation |
| S6 | Isopropyl alcohol | 67-63-0 | KISHIDA CHEMICAL Co., Ltd. | Special grade |
| P1 | Poly(vinylphenol) | 24979-70-2 | Sigma-Aldrich Corporation | Weight average molecular weight (Mw): up to 25000 |
| P2 | Poly(p-vinylphenol) (Trade name: MARUKA LYNCUR-M S-1P) | 24979-70-2 | Maruzen Petrochemical Co., Ltd. | Weight average molecular weight (Mw): 1600 to 2400 |
| P3 | Poly(p-vinylphenol) (Trade name: MARUKA LYNCUR-M S-2P) | 24979-70-2 | Maruzen Petrochemical Co., Ltd. | Weight average molecular weight (Mw): 4000 to 6000 |
| P4 | Poly(p-vinylphenol) (Trade name: MARUKA LYNCUR-M H-2P) | 24979-70-2 | Maruzen Petrochemical Co., Ltd. | Weight average molecular weight (Mw): 19800 to 24200 |
| P5 | Poly(p-vinylphenol) (Trade name: MARUKA LYNCUR- CST-70) | 24979-74-6 | Maruzen Petrochemical Co., Ltd. | Type of copolymerization (copolymerized component: styrene) Content of p-vinylphenol: 50 mol % Weight average molecular weight (Mw): 3000 to 5000 |
| P6 | Phenolic novolac resin (Trade name: TD-2090-60M) | 9003-35-4 | DIC CORPORATION | 60 wt % methyl ethyl ketone solution |
| MA1 | Titanium isopropoxide | 546-68-9 | KISHIDA CHEMICAL Co., Ltd. | |
| MO1 | Titanium oxide (Trade name: CR-EL) | 13463-67-7 | Ishihara Sangyo Kaisha, Ltd. | |
| MA2 | Titanium diisopropoxide bis(acetylacetate) | 17927-72-9 | Tokyo Chemical Industry Co., Ltd. | 75 wt % isopropanol solution |
| MA3 | Tantalum tetraethoxide acetylacetate | 20219-33-4 | Gelest Inc., | |
| MA4 | Aluminum di(sec-butoxide)ethylacetoacetate | 24772-51-8 | Gelest Inc., | |
| MA5 | Pentamethylcyclopentadienyl-titanium trimethoxide | 123927-75-3 | J & K SCIENTIFIC Ltd., | |
| L1 | o-Anisic acid | 579-75-9 | Tokyo Chemical Industry Co., Ltd. | |
| L2 | Guaiacol | 90-05-1 | Tokyo Chemical Industry Co., Ltd. | |
| L3 | Quinaldic acid | 93-10-7 | Tokyo Chemical Industry Co., Ltd. | |
| L4 | 2-Acetylpyrrole | 1072-83-9 | Tokyo Chemical Industry Co., Ltd. | |
| L5 | N,N-Dimethylglycine | 1118-68-9 | Tokyo Chemical Industry Co., Ltd. | |

<Preparation of Coating Liquid>

Production Example E1: Preparation of Coating Liquid E1

[Step 1]

(Preparation of Polymer Solution)

Methyl isobutyl ketone (99.0 g) and poly(vinylphenol) (1.01 g) were placed in a 200 mL glass container, and were stirred to prepare a solution of Poly(Vinylphenol) in Methyl Isobutyl Ketone.

(Preparation of Metal Alkoxide Solution)

Ethanol (15.1 g) and titanium isopropoxide (0.39 g) were placed in a 100 mL glass container, and were stirred to prepare a solution of titanium isopropoxide in ethanol.

(Preparation of Solution of Compound for Ligand)

O-Anisic acid (0.42 g) and ethanol (34.2 g) were placed in a 100 mL glass container, and were stirred to prepare a solution of o-anisic acid in ethanol.

(Preparation of Metal Complex Solution)

The solution of compound for a ligand was added to the metal alkoxide solution prepared above, and was sufficiently stirred. It is believed that in this solution, the titanoxane bond was formed through the hydrolysis and condensation reactions of titanium isopropoxide to form a complex through coordination of o-anisic acid with a titanium atom.

[Step 2]

(Preparation of Coating Liquid)

The polymer solution (35.0 g) and the metal complex solution (15.0 g) were placed in a 100 mL glass container, and were stirred to prepare coating liquid E1.

Production Example C1: Preparation of Coating Liquid C1

A polymer solution or coating liquid C1 was prepared in the same manner as in Production Example E1.

Production Example C2: Preparation of Coating Liquid C2

The metal alkoxide solution and the solution of compound for a ligand were prepared in the same manner as in Production Example E1, and were mixed to prepare a metal complex solution as coating liquid C2.

Production Example E2: Preparation of Coating Liquid E2

[Step 1]

(Preparation of Polymer Solution)

Poly(vinylphenol) (0.45 g) and dimethoxyethane (44.6 g) were placed in a 100 mL glass container, and were stirred to prepare a solution of poly(vinylphenol) in dimethoxyethane.

(Preparation of Metal Alkoxide Solution)

2-Butanol (48.3 g) and titanium isopropoxide (1.78 g) were placed in a 100 mL glass container, and were stirred to prepare a solution of titanium isopropoxide in 2-butanol.

[Step 2]

The polymer solution (45.0 g) and the metal alkoxide solution (5.0 g) were placed in a 100 mL glass container, and were stirred to prepare coating liquid E2.

Production Example C3: Preparation of Coating Liquid C3

A metal alkoxide solution or coating liquid C3 was prepared in the same manner as in Production Example E2.

Production Example C4: Preparation of Coating Liquid C4

Poly(vinylphenol) (0.45 g), dimethoxyethane (44.6 g) and rutile type titanium oxide CR-EL (trade name, manufactured by Ishihara Sangyo Kaisha, Ltd.) (0.051 g) were placed in a 100 mL glass container, and were sufficiently stirred to prepare coating liquid C4.

Production Examples E3 to E6: Preparation of Coating Liquids E3 to E6

[Step 1]

(Preparation of Polymer Solution)

A polymer solution was prepared in the same manner as in Production Example E1 except that the amount of poly (vinylphenol) was changed to 1.00 g.

(Preparation of Metal Complex Solution)

Isopropyl alcohol (48.3 g) and titanium diisopropoxide bis(acetylacetonate) (1.78 g) were placed in a 100 mL glass container, and were stirred to prepare a solution of titanium diisopropoxide bis(acetylacetonate) in isopropyl alcohol. Titanium diisopropoxide bis(acetylacetonate) is a compound having a titanium atom coordinated with acetylacetone. Accordingly, the resulting solution is a metal alkoxide solution and a metal complex solution.

[Step 2]

(Preparation of Coating Liquid)

Coating liquids E3 to E6 were prepared in the same manner as in Production Example E1 except that the solution of titanium diisopropoxide bis(acetylacetonate) in isopropyl alcohol was used as the metal complex solution and the amounts of the metal complex solution and the polymer solution mixed were varied as shown in Table 7.

Production Example C5: Preparation of Coating Liquid C5

A metal complex solution or coating liquid C5 was prepared in the same manner as in Production Example E3.

Production Examples E7 to E11: Preparation of Coating Liquids E7 to E11

A polymer solution was prepared in the same manner as in Production Example E1 except that the polymers having a phenolic hydroxyl group "P2," "P3," "P4," "P5" and "P6" shown in Table 6 were used in the amounts shown in Table 7. Coating liquids E7 to E11 were prepared in the same manner as in Production Example E1 except that the resulting polymer solutions were used. The amount of the solvent is as shown in Table 7.

Production Examples C6 to C10: Preparation of Coating Liquids C6 to C10

Coating liquids C6 to C10 were prepared in the same manner as in Production Example C1 except that the polymers having a phenolic hydroxyl group "P2," "P3," "P4," "P5" and "P6" shown in Table 6 were used in the amounts shown in Table 8 and the amount of the solvent was varied as shown in Table 8.

Production Example E12: Preparation of Coating Liquid E12

[Step 1]

(Preparation of Polymer Solution)

Poly(vinylphenol) (0.45 g) and 2-butanol (44.6 g) were placed in a 100 mL glass container, and were sufficiently stirred to prepare a solution of poly(vinylphenol) in 2-butanol.

(Preparation of Solution of Metal Complex)

Tantalum tetraethoxide acetylacetonate (0.74 g) and 2-butanol (49.3 g) were placed in a 100 mL glass container, and were sufficiently stirred to prepare a solution of tantalum tetraethoxide acetylacetonate in 2-butanol. Tantalum tetraethoxide acetylacetonate is a compound having a tantalum atom coordinated with acetylacetone. Accordingly, the resulting solution is a metal alkoxide solution and a metal complex solution.

[Step 2]

(Preparation of Coating Liquid)

The polymer solution (35.0 g) and the metal complex solution (15.0 g) were placed in a 100 mL glass container, and were stirred to prepare coating liquid E12.

Production Example E13: Preparation of Coating Liquid E13

[Step 1]

(Preparation of Polymer Solution)

Poly(vinylphenol) (0.44 g) and 2-butanol (44.5 g) were placed in a 100 mL glass container, and were sufficiently stirred to prepare a solution of poly(vinylphenol) in 2-butanol.

(Preparation of Solution of Metal Complex)

Aluminum di(sec-butoxide)ethylacetoacetate (1.34 g) and 2-butanol (48.6 g) were weighed, were placed in a 100 mL glass container, and were sufficiently stirred to prepare a solution of aluminum di(sec-butoxide)ethylacetoacetate in 2-butanol. Aluminum di(sec-butoxide)ethylacetoacetate is a compound having an aluminum atom coordinated with acetoacetate ester. Accordingly, the solution prepared in this step is a solution of a metal alkoxide and a solution of a metal complex.

[Step 2]

(Preparation of Coating Liquid)

The polymer solution (35.0 g) and the metal complex solution (15.0 g) were placed in a 100 mL glass container, and were stirred to prepare coating liquid E13.

Production Example C11: Preparation of Coating Liquid C11

Tantalum tetraethoxide acetylacetonate (0.73 g) and 2-butanol (49.3 g) were placed in a 100 mL glass container, and were sufficiently stirred to prepare coating liquid C11.

Production Example C12: Preparation of Coating Liquid C12

Aluminum di(sec-butoxide)ethylacetoacetate (1.33 g) and 2-butanol (48.6 g) were placed in a 100 mL glass container, and were stirred to prepare coating liquid C12.

Production Examples E14 to E16: Preparation of Coating Liquids E14 to E16

[Step 1]

(Preparation of Polymer Solution)

A polymer solution was prepared in the same manner as in Production Example E3.

(Preparation of Metal Alkoxide Solution)

Three metal alkoxide solutions were prepared in the same manner as in Production Example E1 except that the amounts of titanium isopropoxide and the solvent were varied as shown in Table 7.

(Preparation of Solution of Compound for Ligand)

A solution of compound for a ligand was prepared in the same manner as in Production Example E1 except that the amounts of the compound for a ligand and the solvent were varied as shown in Table 7.

(Preparation of Metal Complex Solution)

Three metal complex solutions were prepared in the same manner as in Production Example E1 except that the three metal alkoxide solutions and the solution of compound for a ligand were used.

[Step 2]

(Preparation of Coating Liquid)

Coating liquids E14 to E16 were prepared in the same manner as in Production Example E1 except that the polymer solution and the three metal complex solutions were mixed in the amounts shown in Table 7.

Production Examples E17 to E20: Preparation of Coating Liquids E17 to E20

[Step 1]

(Preparation of Polymer Solution)

A polymer solution was prepared in the same manner as in Production Example E3.

(Preparation of Metal Alkoxide Solution)

Four metal alkoxide solutions were prepared in the same manner as in Production Example E1 except that the amounts of titanium isopropoxide and the solvent were varied as shown in Table 7.

(Preparation of Solution of Compound for Ligand)

Amounts of guaiacol and ethanol as shown in Table 7 were placed in a 100 mL glass container, and were stirred to prepare a solution of guaiacol in ethanol.

(Preparation of Metal Complex Solution)

The four metal alkoxide solutions were each mixed with the solution of compound for a ligand to prepare four metal complex solutions.

[Step 2]

(Preparation of Coating Liquid)

Coating liquids E17 to 20 were prepared in the same manner as in Production Example E1 except that the polymer solution and the four metal complex solutions were mixed in the amounts shown in Table 7.

Production Example C13: Preparation of Coating Liquid C13

A metal alkoxide solution and a solution of compound for a ligand were prepared in the same manner as in Production Example E19, and were mixed to prepare a metal complex solution or coating liquid C13.

Production Example E21: Preparation of Coating Liquid E21

[Step 1]

(Preparation of Polymer Solution)

A polymer solution was prepared in the same manner as in Production Example E3.

(Preparation of Solution of Metal Alkoxide)

Ethanol (15.1 g) and titanium isopropoxide (0.39 g) were weighed, were placed in a 100 mL glass container, and were stirred to prepare a solution of titanium isopropoxide in ethanol.

(Preparation of Solution of Compound for Ligand)

O-Anisic acid (0.42 g), ethanol (34.1 g) and ion-exchanged water (0.049 g) were placed in a 100 mL glass container, and were stirred to prepare a solution of o-anisic acid in ethanol.

(Preparation of Metal Complex Solution)

A metal complex solution was prepared in the same manner as in Production Example E1 except that the metal alkoxide solution and the solution of compound for a ligand were used.

[Step 2]

(Preparation of Coating Liquid)

The polymer solution (35.0 g) and the solution of titanium+o-anisic acid in ethanol (15.0 g) were placed in a 100 mL glass container, and were stirred to prepare coating liquid E21.

Production Example E22: Preparation of Coating Liquid E22

[Step 1]

(Preparation of Polymer Solution)

Methyl isobutyl ketone (99.1 g) and poly(vinylphenol) (1.01 g) were placed in a 100 mL glass container, and were stirred to prepare a solution of poly(vinylphenol) in methyl isobutyl ketone.

(Preparation of Metal Alkoxide Solution)

Ethanol (15.0 g) and titanium isopropoxide (0.35 g) were placed in a 100 mL glass container, and were stirred to prepare a solution of titanium isopropoxide in ethanol.

(Preparation of Solution of Compound for Ligand)

Quinaldic acid (0.43 g), ethanol (34.2 g) and ion-exchanged water (0.044 g) were placed in a 100 mL glass container, and were stirred to prepare a solution of quinaldic acid in ethanol.

(Preparation of Metal Complex Solution)

A metal complex solution was prepared in the same manner as in Production Example E1 except that the metal alkoxide solution and the solution of compound for a ligand were used.

[Step 2]

(Preparation of Coating Liquid)

The polymer solution (35.0 g) and the solution of titanium+quinaldic acid in ethanol (15.0 g) were placed in a 100 mL glass container, and were stirred to prepare coating liquid E22.

Production Examples E23 and E24: Preparation of Coating Liquids E23 and E24

[Step 1]

(Preparation of Polymer Solution)

A solution of poly(vinylphenol) in methyl isobutyl ketone was prepared in the same manner as in Production Example E1 except that the amounts of methyl isobutyl ketone and poly(vinylphenol) were varied as shown in Table 7.

(Preparation of Metal Alkoxide Solution)

A solution of titanium isopropoxide in ethanol was prepared in the same manner as in Production Example E1 except that the amounts of ethanol and titanium isopropoxide were varied as shown in Table 7.

(Preparation of Solution of Compound for Ligand)

A solution of compound for a ligand was prepared in the same manner as in Production Example E1 except that 2-acetylpyrrole and N,N-dimethylglycine were used as the compound for a ligand in the amounts shown in Table 7 and the amount of ethanol was 34.1 g.

(Preparation of Metal Complex Solution)

The solution of compound for a ligand was added to the metal alkoxide solution, and was mixed with stirring to prepare a metal complex solution.

[Step 2]

(Preparation of Coating Liquid)

The polymer solution (35.0 g) and the metal complex solution (15.0 g) were placed in a 100 mL glass container, and were stirred to prepare coating liquids E23 and E24.

Production Example E25: Preparation of Coating Liquid E25

[Step 1]

(Preparation of Polymer Solution)

Methyl isobutyl ketone (99.1 g) and poly(vinylphenol) (1.01 g) were weighed, were placed in a 100 mL glass container, and were stirred to prepare a solution of poly (vinylphenol) in methyl isobutyl ketone.

(Preparation of Solution of Metal Complex)

Ethanol (50.0 g) and pentamethylcyclopentadienyltitanium trimethoxide (0.39 g) were weighed, were placed in a 100 mL glass container, and were stirred to prepare a solution of pentamethylcyclopentadienyltitanium trimethoxide in ethanol. Pentamethylcyclopentadienyltitanium trimethoxide is a compound having a titanium atom coordinated with a pentamethylcyclopentadienyl group. Accordingly, the solution prepared in this step is a solution of a metal alkoxide and a solution of a metal complex.

[Step 2]

(Preparation of Coating Liquid)

The polymer solution (45.0 g) and the metal complex solution (5.0 g) were placed in a 100 mL glass container, and were stirred to prepare coating liquid E25.

The formulae of coating liquids E1 to E25 are shown in Table 7. The formulae of coating liquids C1 to C13 is shown in Table 8.

TABLE 7

| | | STEP 1 | | | | | | | | | | | | | | | | STEP 2 Amount mixed (g) | |
|---|---|---|---|---|---|---|---|---|---|---|---|---|---|---|---|---|---|---|---|
| | | Solution (1) of polymer having phenolic hydroxyl group | | | | Solution of metal complex, (2) | | | | | | | | | | | | | |
| Production Example | Coating liquid No. | Polymer A (g) | | Solvent for A (g) | | Metal alkoxide M(g) | | Solvent for M (g) | | Compound for ligand, L (g) | | Solvent for L(g) | | Others (g) | | (1) | (2) |
| E1 | E1 | P1 | 1.01 | S3 | 99.0 | MA1 | 0.39 | S2 | 15.1 | L1 | 0.42 | S2 | 34.2 | — | — | 35.0 | 15.0 |
| E2 | E2 | P1 | 0.45 | S4 | 44.6 | MA1 | 1.78 | S1 | 48.3 | — | — | — | — | — | — | 45.0 | 5.0 |
| E3 | E3 | P1 | 1.00 | S3 | 99.0 | MA2 | 1.78 | S6 | 48.3 | (Acetylacetone) | — | — | — | — | — | 45.0 | 5.0 |
| E4 | E4 | P1 | 1.00 | S3 | 99.0 | MA2 | 1.78 | S6 | 48.3 | (Acetylacetone) | — | — | — | — | — | 35.0 | 15.0 |
| E5 | E5 | P1 | 1.00 | S3 | 99.0 | MA2 | 1.78 | S6 | 48.3 | (Acetylacetone) | — | — | — | — | — | 25.0 | 25.0 |
| E6 | E6 | P1 | 1.00 | S3 | 99.0 | MA2 | 1.78 | S6 | 48.3 | (Acetylacetone) | — | — | — | — | — | 15.0 | 35.0 |
| E7 | E7 | P2 | 1.02 | S3 | 99.1 | MA1 | 0.39 | S2 | 15.0 | L1 | 0.42 | S2 | 34.2 | — | — | 35.0 | 15.0 |
| E8 | E8 | P3 | 1.01 | S3 | 99.0 | MA1 | 0.39 | S2 | 15.0 | L1 | 0.42 | S2 | 34.2 | — | — | 35.0 | 15.0 |
| E9 | E9 | P4 | 1.02 | S3 | 99.0 | MA1 | 0.39 | S2 | 15.0 | L1 | 0.42 | S2 | 34.2 | — | — | 35.0 | 15.0 |
| E10 | E10 | P5 | 1.00 | S3 | 99.1 | MA1 | 0.39 | S2 | 15.0 | L1 | 0.42 | S2 | 34.3 | — | — | 35.0 | 15.1 |
| E11 | E11 | P6 | 1.01 | S3 | 99.0 | MA1 | 0.39 | S2 | 15.0 | L1 | 0.42 | S2 | 34.3 | — | — | 35.1 | 15.0 |

TABLE 7-continued

| | | STEP 1 | | | | | | | | | | | | | | STEP 2 Amount mixed (g) | |
|---|---|---|---|---|---|---|---|---|---|---|---|---|---|---|---|---|---|
| | | Solution (1) of polymer having phenolic hydroxyl group | | | | Solution of metal complex, (2) | | | | | | | | | | | |
| Production Example | Coating liquid No. | Polymer A (g) | | Solvent for A (g) | | Metal alkoxide M(g) | | Solvent for M (g) | | Compound for ligand, L (g) | | Solvent for L(g) | | Others (g) | | (1) | (2) |
| E12 | E12 | P1 | 0.45 | S1 | 44.6 | MA3 | 0.74 | S1 | 49.3 | (Acetylacetone) | — | — | — | — | — | 35.0 | 15.0 |
| E13 | E13 | P1 | 0.44 | S1 | 44.5 | MA4 | 1.34 | S1 | 48.6 | (Acetoacetate ester) | — | — | — | — | — | 35.0 | 15.0 |
| E14 | E14 | P1 | 1.00 | S3 | 99.0 | MA1 | 0.64 | S2 | 15.1 | L1 | 0.35 | S2 | 34.0 | — | — | 35.0 | 15.0 |
| E15 | E15 | P1 | 1.00 | S3 | 99.0 | MA1 | 0.39 | S2 | 15.0 | L1 | 0.42 | S2 | 34.2 | — | — | 35.0 | 15.0 |
| E16 | E16 | P1 | 1.00 | S3 | 99.0 | MA1 | 0.28 | S2 | 15.0 | L1 | 0.46 | S2 | 34.3 | — | — | 35.0 | 15.0 |
| E17 | E17 | P1 | 1.00 | S3 | 99.0 | MA1 | 0.46 | S2 | 15.0 | L2 | 0.41 | S2 | 34.1 | — | — | 45.0 | 5.0 |
| E18 | E18 | P1 | 1.00 | S3 | 99.0 | MA1 | 0.46 | S2 | 15.1 | L2 | 0.41 | S2 | 34.1 | — | — | 35.0 | 15.0 |
| E19 | E19 | P1 | 1.00 | S3 | 99.0 | MA1 | 0.46 | S2 | 15.0 | L2 | 0.41 | S2 | 34.2 | — | — | 25.0 | 25.0 |
| E20 | E20 | P1 | 1.00 | S3 | 99.0 | MA1 | 0.46 | S2 | 15.0 | L2 | 0.41 | S2 | 34.1 | — | — | 15.0 | 35.0 |
| E21 | E21 | P1 | 1.00 | S3 | 99.0 | MA1 | 0.39 | S2 | 15.1 | L1 | 0.42 | S2 | 34.1 | S5 | 0.049 | 35.0 | 15.0 |
| E22 | E22 | P1 | 1.01 | S3 | 99.1 | MA1 | 0.35 | S2 | 15.0 | L3 | 0.43 | S2 | 34.2 | S5 | 0.044 | 35.0 | 15.0 |
| E23 | E23 | P1 | 1.00 | S3 | 99.1 | MA1 | 0.39 | S2 | 15.0 | L4 | 0.42 | S2 | 34.1 | — | — | 35.0 | 15.0 |
| E24 | E24 | P1 | 1.00 | S3 | 99.0 | MA1 | 0.53 | S2 | 15.1 | L5 | 0.39 | S2 | 34.1 | — | — | 35.0 | 15.0 |
| E25 | E25 | P1 | 1.01 | S3 | 99.1 | MA5 | 0.39 | S2 | 50.0 | (Pentamethyl-cyclopentadienyl) | — | — | — | — | — | 45.0 | 5.0 |

TABLE 8

| | | STEP 1 | | | | | | | | | | | | | | STEP 2 Amount mixed (g) | |
|---|---|---|---|---|---|---|---|---|---|---|---|---|---|---|---|---|---|
| | | Solution (1) of polymer having phenolic hydroxyl group | | | | Solution of metal complex, (2) | | | | | | | | | | | |
| Production Example | Coating liquid No. | Polymer A (g) | | Solvent for A (g) | | Metal alkoxide M (g) | | Solvent for M (g) | | Compound for ligand, L (g) | | Solvent for L (g) | | Others (g) | | (1) | (2) |
| C1 | C1 | P1 | 1.01 | S3 | 99.0 | — | — | — | — | — | — | — | — | — | — | — | — |
| C2 | C2 | — | — | — | — | MA1 | 0.39 | S2 | 15.1 | L1 | 0.42 | S2 | 34.2 | — | — | — | — |
| C3 | C3 | — | — | — | — | MA1 | 1.78 | S1 | 48.3 | — | — | — | — | — | — | — | — |
| C4 | C4 | P1 | 0.45 | S4 | 44.6 | — | — | — | — | — | — | — | — | MO1 | 0.051 | — | — |
| C5 | C5 | — | — | — | — | MA2 | 1.78 | S6 | 48.3 | (Acetylacetone) | — | — | — | — | — | — | — |
| C6 | C6 | P2 | 1.02 | S3 | 99.1 | — | — | — | — | — | — | — | — | — | — | — | — |
| C7 | C7 | P3 | 1.01 | S3 | 99.0 | — | — | — | — | — | — | — | — | — | — | — | — |
| C8 | C8 | P4 | 1.02 | S3 | 99.0 | — | — | — | — | — | — | — | — | — | — | — | — |
| C9 | C9 | P5 | 1.00 | S3 | 99.0 | — | — | — | — | — | — | — | — | — | — | — | — |
| C10 | C10 | P6 | 1.01 | S3 | 99.1 | — | — | — | — | — | — | — | — | — | — | — | — |
| C11 | C11 | — | — | — | — | MA3 | 0.73 | S1 | 49.3 | (Acetylacetone) | — | — | — | — | — | — | — |
| C12 | C12 | — | — | — | — | MA4 | 1.33 | S1 | 48.6 | (Acetoacetate ester) | — | — | — | — | — | — | — |
| C13 | C13 | — | — | — | — | MA1 | 0.46 | S2 | 15.0 | L2 | 0.41 | S2 | 34.2 | — | — | — | — |

<Structural Analysis of Polymetalloxane>

The structures of the polymetalloxanes formed of the coating liquids were analyzed by the following methods.

(1) Presence of a bond between the phenolic hydroxyl group in the polymer and the metal atom of the metalloxane: solid NMR (2) Presence of the metalloxane bond in the polymetalloxane: solid NMR (3) Presence of the metal atom in the polymetalloxane: EDAX (4) Presence of a ligand coordinated with the metal atom in the metalloxane structure: solid NMR (5) Analysis of the crystal structure of the polymetalloxane: XRD Hereinafter, the methods of analysis will be described in detail.

(1) Solid NMR analysis (Bonding of phenolic hydroxyl group to metal atom)

Coating liquid E2 and coating liquid C4 were each dropped onto an aluminum sheet degreased with ethanol. The sheets were then rotated at 300 rpm for 2 seconds to form coatings. The coatings were dried under an environment at normal temperature and normal humidity (temperature: 23° C., relative humidity: 50%) for 60 minutes. The sheets were placed in a hot air circulating drying furnace, and were dried at a temperature of 80° C. for 60 minutes. The resulting coatings were peeled from the sheets, and were ground to prepare samples for measurement.

These samples were measured with a nuclear magnetic resonance apparatus (trade name: NMR spectrometer ECX 500 II; manufactured by JOEL RESONANCE Inc.) by solid NMR ($^{13}$C-CPMAS method) to perform NMR analysis. The measurement was performed using a sample tube having an outer diameter of 3.2 mm at an MAS rate of 15 kHz and the integrated number of rotations of 256.

Figure 5:
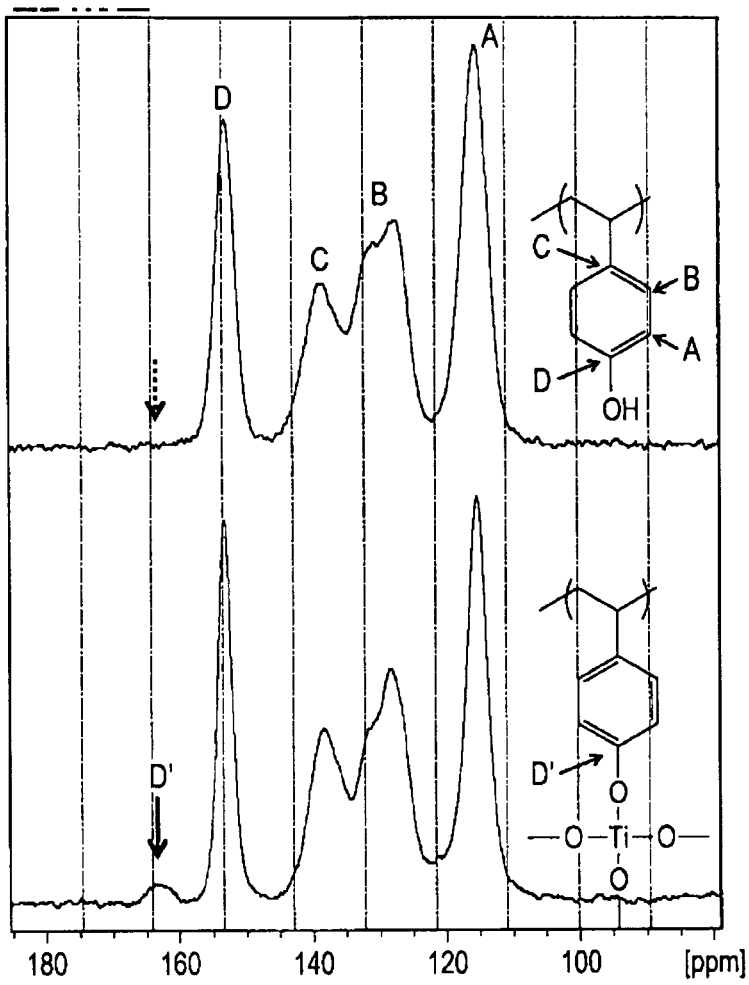
FIG. 5 is a diagram illustrating the results of solid NMR analysis of the coatings formed of coating liquid E2 (lower chart) and coating liquid C4 (upper chart).

The results of measurement by solid NMR are illustrated in FIG. 5. In FIG. 5, the lower chart is the spectrum of the sample according to coating liquid E2, and the upper chart is the spectrum of the sample according to coating liquid C4.

The polymetalloxane surface layer formed with coating liquid E2 had a peak D', which was not present in the starting material. It is inferred that this is because the peak D of the carbon atom bonded to the hydroxyl group in poly(vinylphenol) was shifted as a result of the reaction between the hydroxyl group and titanium isopropoxide. Accordingly, it was verified that poly(vinylphenol) reacted with titanium isopropoxide.

The structures of coating liquids E1 and E3 to E25 were analyzed in the same manner as above. As a result, it was verified that the phenolic hydroxyl group reacted with the metal atom in the polymetalloxane.

(2) Solution NMR analysis (metalloxane bond)

$^{17}O$ was introduced into coating liquid E2 with oxygen 17-labeled water (50 atom %), and coating liquid E2 was measured with a nuclear magnetic resonance apparatus (trade name: AVANCE 500 NMR; manufactured by Bruker Corporation) to measure the NMR of the solution $^{17}O$ and perform NMR analysis. As a result, peaks were detected at 300 to 800 ppm in the $^{17}O$-NMR spectrum, and the presence of Ti—O—Ti bonds was verified.

(3) Element Analysis

Samples prepared in the same manner as in (1) were observed with a scanning electron microscope (SEM) (trade name: S-3700N, manufactured by Hitachi High-Technologies Corporation), and element analysis was performed with an energy dispersive X-ray analyzer (trade name: Xflash 6/30, manufactured by Bruker Corporation). The element analysis was performed in the viewing field at an applied voltage of 20 kV, a current of a probe of 80 mA, and a magnification of ×300. As a result, K-α ray peaks derived from the Ti atom appeared at about 4.5 keV, and the presence of the Ti atoms was verified.

(4) Solid NMR Analysis (Coordination of Ligand with Metal Atom)

Samples were prepared in the same manner as in (1) except that coating liquid E1 was used. The samples were measured with a nuclear magnetic resonance apparatus (trade name: NMR spectrometer ECX 500 II; manufactured by JOEL RESONANCE Inc.) by solid NMR ($^{13}C$-CPMAS method) to perform NMR analysis. The measurement was performed using a sample tube having an outer diameter of 3.2 mm at an MAS rate of 15 kHz and the integrated number of rotations of 256. As a result, it was verified that the peak (attributed to the carbon atom bonded to the methoxy group of o-anisic acid) detected at 160 ppm in the $^{13}C$-NMR spectrum was shifted to a lower magnetic field, and o-anisic acid was coordinated with Ti.

(5) Analysis of Crystal Structure by XRD

Coating liquid E2 and coating liquid C4 were each dropped onto an aluminum sheet degreased with ethanol. The sheets were then rotated at 300 rpm for 2 seconds to form coatings. The coatings were dried under an environment at normal temperature and normal humidity (temperature: 23° C., relative humidity: 50%) for 60 minutes. The sheets were placed in a hot air circulating drying furnace, and were dried at a temperature of 80° C. for 60 minutes. The resulting coatings were peeled from the sheets, and were ground to prepare samples for measurement.

The samples were disposed in an aluminum sample holder such that the surfaces to be measured were smoothly aligned. The samples were 2θ/θ scanned with an X-ray diffraction apparatus (trade name: RINT-TTR II; manufactured by Rigaku Corporation), and were measured at 2θ=3 to 60°. The X-ray diffraction measurement was performed by a parallel beam method at an X-ray output of 50 kV using a CuKα-ray of 300 mA and a vertical diffusion restricting slit of 10.0 mm. The results of measurement are illustrated in FIGS. 6A and 6B.

Figure 6A:
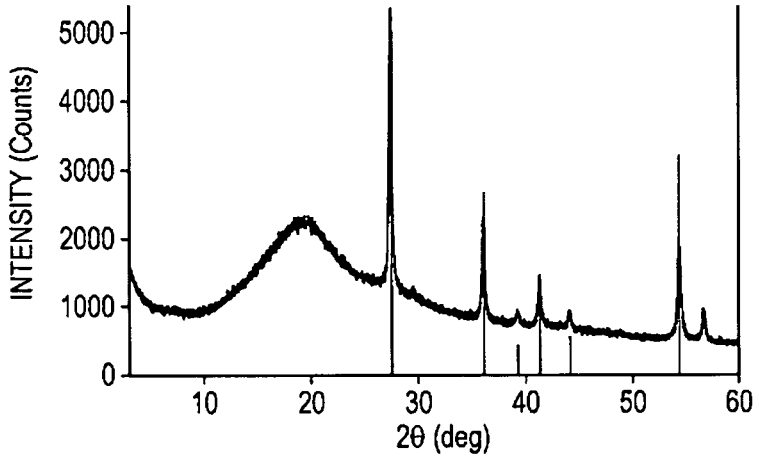
FIG. 6A is a diagram illustrating the results of analysis of the crystal structure of titanium oxide in the coating formed of coating liquid C4.
Figure 6B:
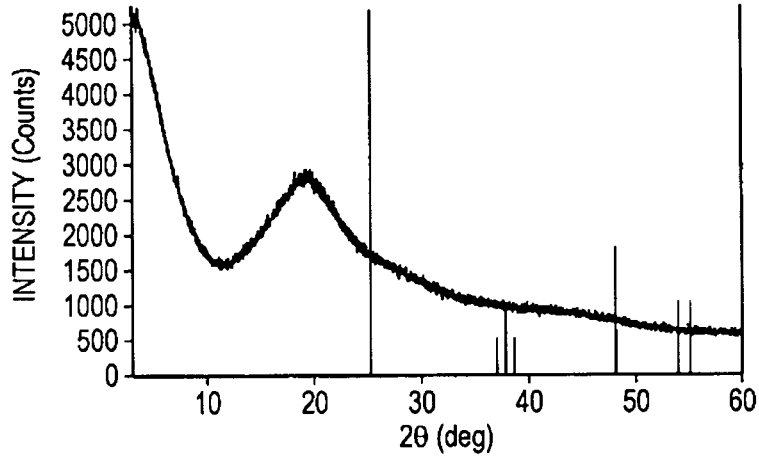
FIG. 6B is a diagram illustrating the results of analysis of the crystal structure of titanium oxide in the coating formed of coating liquid E2.
Figure 7:
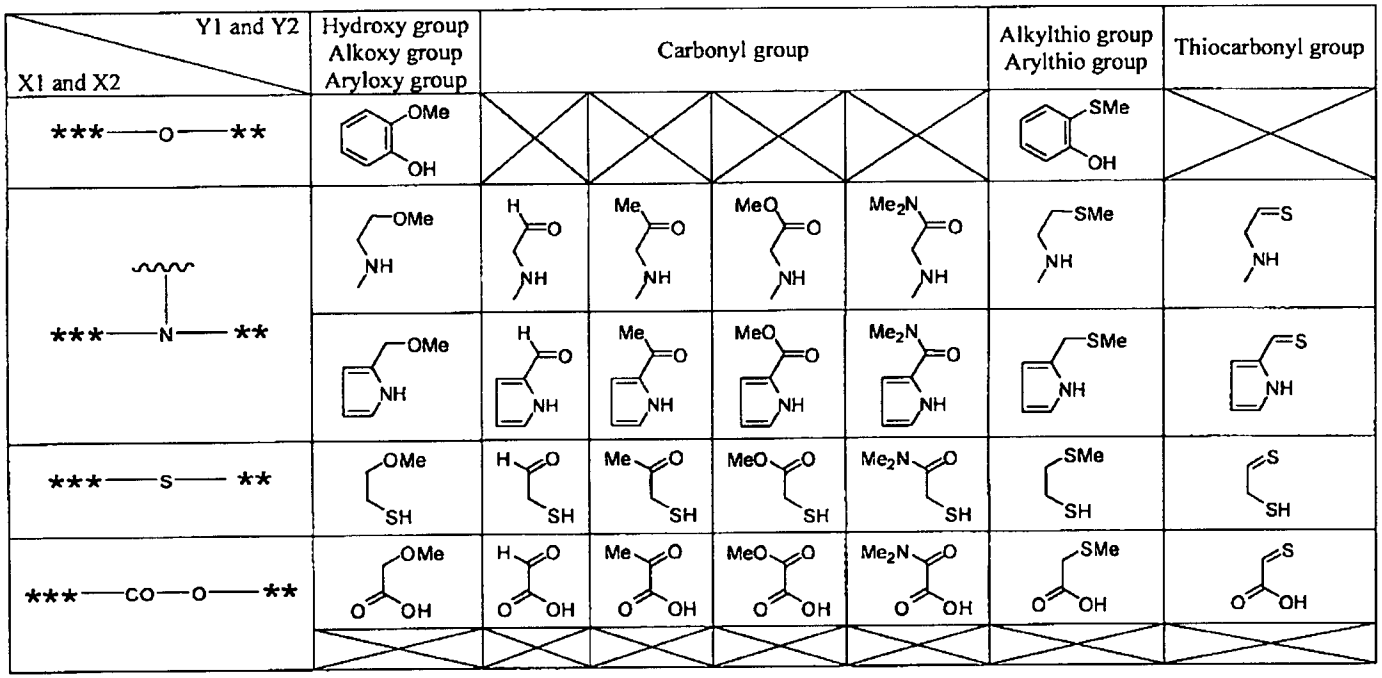
FIGS. 7-10 provide specific examples of the compound for a ligand represented by Formula (b).
Figure 8:
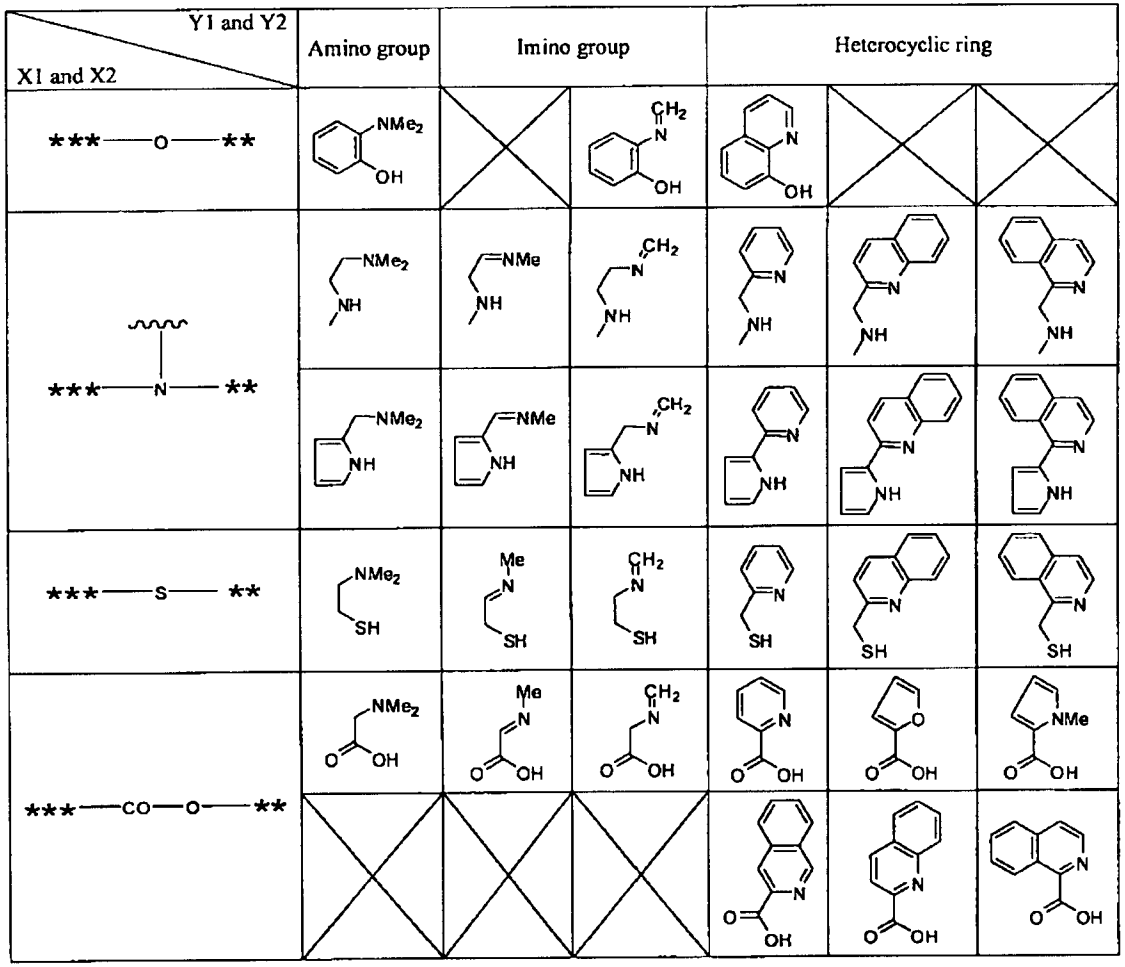
Figure 9:
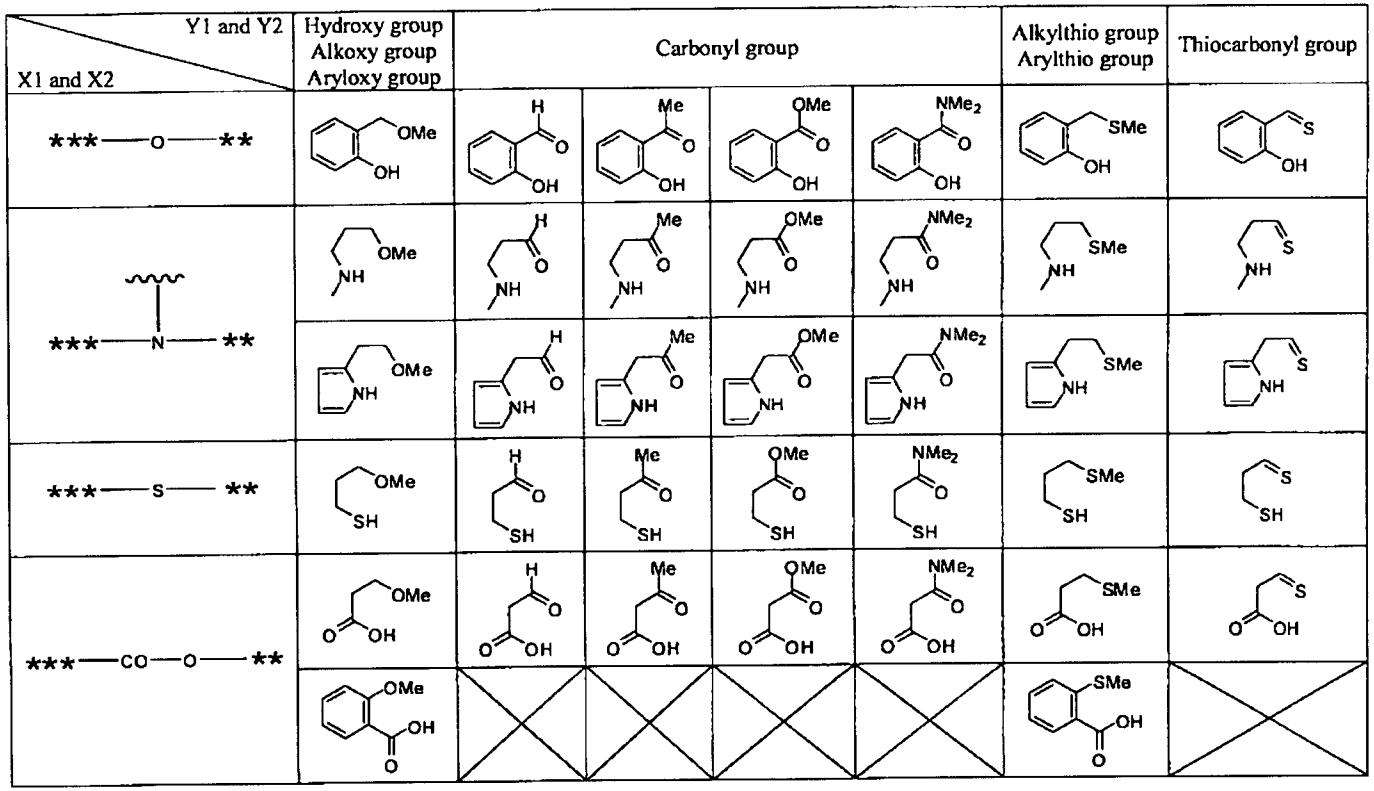
Figure 10:
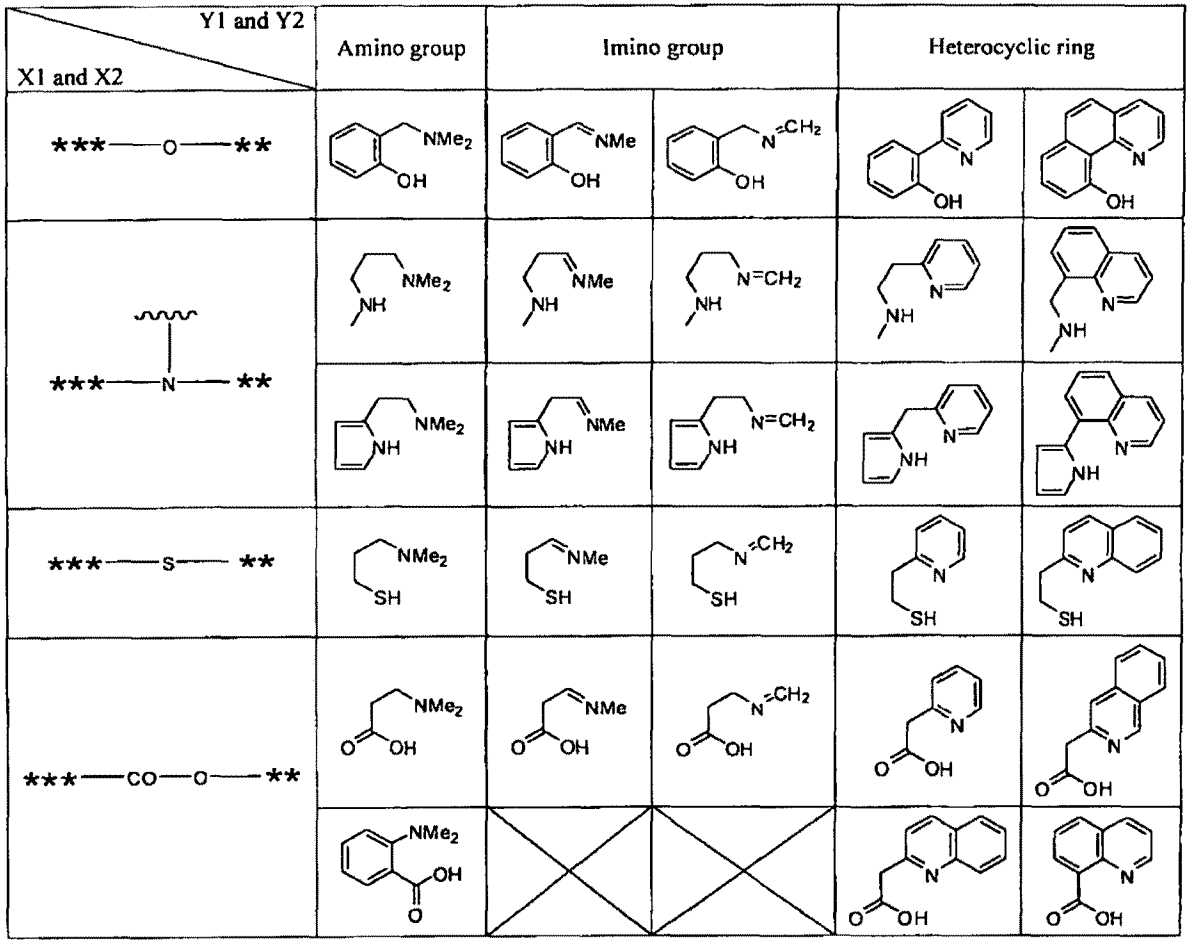

As illustrated in FIG. 6A, the peak of titanium oxide having a rutile type crystal structure was observed in the surface layer of coating liquid C4. In contrast, as illustrated in FIG. 6B, the surface layer of coating liquid E2 had no peak derived from a crystal structure. From this, it was verified that titanium oxide in the surface layer was in an amorphous state.

Samples prepared with coating liquids E1 and E3 to E25 were subjected to crystal structure analysis in the same manner as above. As a result, a peak derived from a crystal structure was not observed in any of the samples. From this, it was verified that titanium oxide in the surface layer was in an amorphous state.

Example 1

<Preparation of Charging Member E1>

[Preparation of Electroconductive Elastic Roller 1]

The materials shown in Table 9 were mixed in a 6 L pressurized kneader (trade name: TD6-15MDX, manufactured by Toshin Co., Ltd.) at a filling rate of 70% by volume and a number of rotation of the blade of 30 rpm for 24 minutes to prepare an unvulcanized rubber composition. Tetrabenzylthiuram disulfide (trade name: Sanceler TBzTD, manufactured by Sanshin Chemical Industry Co., Ltd.) (4.5 parts) as a vulcanization accelerator and sulfur (1.2 parts) as a vulcanizing agent were added to the unvulcanized rubber composition (174 parts by mass). These materials were horizontally turned 20 times in total with open rolls each having a roll diameter of 12 inches at a number of rotations of the forward roll of 8 rpm, a number of rotations of the back roll of 10 rpm, and an interval of the rolls of 2 mm. Subsequently, tight milling was performed 10 times at an interval of the rolls of 0.5 mm to prepare "Kneaded product 1" for an electroconductive elastic layer.

TABLE 9

| Raw materials | Amount used (parts by mass) |
|---|---|
| Medium-high nitrile NBR (Trade name: Nipol DN219, manufactured by ZEON Corporation) | 100 |
| Coloring grade carbon black (Trade name: #7360, manufactured by Tokai Carbon Co., Ltd.) | 48 |
| Calcium carbonate (Trade name: NANOX #30, manufactured by Maruo Calcium Co., Ltd.) | 20 |
| Zinc oxide (Trade name: Two zinc oxides; manufactured by Sakai Chemical Industry Co., Ltd.) | 5 |
| Stearic acid (Trade name: Zinc stearate; manufactured by NOF CPRPORATION) | 1 |
| PMMA resin particles (Trade name: Techpolymer MBX-5; manufactured by SEKISUI PLASTICS CO., LTD.) | 10 |

Next, a cylindrical support made of steel and having a diameter of 6 mm and a length of 252 mm (having a nickel-placed surface. Hereinafter, referred to as "core metal") was prepared. A thermosetting adhesive containing a metal and rubber (trade name: METALOC U-20, manufactured by Toyokagaku Kenkyusho Co., Ltd.) was applied onto a region of the core metal in width of 115.5 mm ranging from the center in the axis direction toward each end of the core metal (the region having a total width of 231 mm in the axis direction). This core metal was dried at a temperature of 80° C. for 30 minutes, and further at 120° C. for 1 hour to form an adhesive layer.

By extrusion molding using a crosshead, Kneaded product 1 preliminarily prepared was simultaneously extruded coaxially with the core, i.e., the core metal with the adhesive layer into a cylindrical shape having an outer diameter of 8.75 to 8.90 mm. Both ends were cut off to prepare a roller including a core metal and an unvulcanized electroconductive elastic layer disposed on the outer periphery of the core metal. The extruder used had a cylinder diameter of 70 mm and L/D=20. The temperatures of the head, the cylinder and the screw during extrusion were adjusted to 90° C. The roller was vulcanized in a continuous heating furnace provided with two zones having different temperatures. The first zone was set at a temperature of 80° C., and the roller was passed through the first zone in 30 minutes; then, the second zone was set at a temperature of 160° C., and the roller was passed through the second zone in 30 minutes to prepare electroconductive elastic roller 1.

Next, both ends of the electroconductive elastic layer portion (rubber portion) of Electroconductive elastic roller 1 were cut off to prepare an electroconductive elastic layer having a width in the axis direction of 232 mm. Subsequently, the surface of the electroconductive elastic layer was polished with a rotary grinding wheel (the number of rotations of the work: 333 rpm, the number of rotations of the grinding wheel: 2080 rpm, polishing time: 12 sec). Electroconductive elastic roller 1 was thereby prepared. Electroconductive elastic roller 1 had a crown shape having an end diameter: 8.26 mm and a central diameter: 8.50 mm, a surface ten-point height of irregularities Rz: 5.5 μm, a runout: 18 μm, and a hardness (Asker C): 73°.

The ten-point height of irregularities Rz was determined according to Japanese Industrial Standard (JIS) B 0601: 2013. The runout was determined with a high precision laser analyzer (Trade name: LSM 430v; manufactured by Mitutoyo Corporation). Specifically, the outer diameter of the electroconductive elastic roller was measured with the analyzer to determine an outer diameter difference runout from the largest outer diameter and the smallest outer diameter. Five points of the electroconductive elastic roller were subjected to this measurement. The average of the five outer diameter difference runouts was defined as the runout of the target electroconductive elastic roller. The Asker C hardness was measured as follows: A probe of Asker Type C Durometer (manufactured by Kobunshi Keiki Co., Ltd.) was brought into contact with the surface of the target electroconductive elastic roller under a pressure of 1000 g under an environment at 25° C. and 55% RH.

The surface of electroconductive elastic roller 1 after polishing was observed with an optical microscope (trade name: laser microscope VK8700, manufactured by Keyence Corporation) to measure the dimensions of the electrically insulating domains derived from a poly(methyl methacrylate) (PMMA) resin. Specifically, the measurement was performed according to the following procedure. The magnification of the optical microscope is adjusted such that at least 10 unaggregated electrically insulating domains are observed in the field. The diameters and areas of the 10 unaggregated electrically insulating domains in the field are calculated. The average of the diameters and that of the areas of the 10 electrically insulating domains (rounded to the nearest whole number) are defined as the average diameter and the average area of the electrically insulating domains. The electrically insulating domains derived from the PMMA resin in electroconductive elastic roller 1 had an average diameter of 5 μm and an average area of 20 $\mu m^2$.

The surface of electroconductive elastic roller 1 was observed with the optical microscope to determine the height of the electrically insulating domains derived from the PMMA resin. Specifically, the measurement was performed according to the following procedure. The surface of electroconductive elastic roller 1 is observed at a magnification of 50× and a pitch of 0.1 μm to measure the height from the surface of the electroconductive elastic layer to the vertex portion of an electrically insulating domain. Ten electrically insulating domains are measured, and the heights of the electrically insulating domains are calculated. The average of the heights of the 10 electrically insulating domains (rounded to the nearest whole number) is defined as the average height of the electrically insulating domains. In electroconductive elastic roller 1, the electrically insulating domains derived from the PMMA resin had an average height of 3 μm.

[Formation of Surface Layer]

Electroconductive elastic roller 1 was ring coated with coating liquid E1 at an output rate of 0.120 ml/s (speed of the ring area: 85 mm/s). The roller was left at normal temperature and normal pressure to be dried. The roller was then irradiated with ultraviolet light at a wavelength of 254 nm in an accumulated amount of light of 9000 mJ/$cm^2$ to form a surface layer with thickness of 0.2 μm. The roller was irradiated with ultraviolet light from a low pressure mercury lamp (manufactured by TOSHIBA LIGHTING & TECHNOLOGY CORPORATION (Toshiba Lighting Corporation)). Charging member E1 was thereby prepared.

The surface of charging member E1 was cut out to observe the cross-section thereof. It was verified that the electrically insulating domains derived from the PMMA resin were exposed on the surface of the electroconductive elastic layer of charging member E1, and the surface layer was formed thereon. The cross-section was observed as follows: A carbon deposited film was formed on the surface of the roller in the target portion with an FIB-SEM (trade name: NVision40, manufactured by SII NanoTechnology Inc.). While the beam current was reduced stepwise from 27 nA, the target portion was cut out at an accelerating voltage of 30 kV to obtain a cross-section. The cross-section was observed at an accelerating voltage of 1 kV and a magnification of 2000×.

<Evaluation of Abnormal Discharge>

The charging roller mounted on a cyan cartridge for a laser printer (trade name: HP Color Laser Jet CP4525, manufactured by Hewlett-Packard Company) was replaced with charging member E1 prepared above. This cartridge was set on a laser printer (trade name: HP Color Laser Jet CP4525, manufactured by Hewlett-Packard Company, thickness of the charge transport layer of the photosensitive member: 23 μm), and a halftone image was formed on A4 size paper.

An electrophotographic image was formed without pre-exposure. The charge voltage was set at −1141 V, and the transfer voltage was set at 2575 V. These settings produce an environment more readily generating abnormal discharge. The electrophotographic image was output under an environment at low temperature and low humidity (temperature: 15° C., humidity: 10%). Absence or presence of the unevenness of the image attributed to abnormal discharge was visually observed in the halftone image to evaluate the generation of abnormal discharge. As a result, no abnormal discharge was observed in charging member E1. The results are shown in Table 10. In Table 10, the absence or presence of the generation of abnormal discharge is shown as follows.

A: No abnormal discharge was observed.

B: Abnormal discharge was observed.

In Table 10, "M/L" represents the ratio of the molar amount (L) of the ligand to the molar amount (M) of the metal atom in the polymetalloxane forming the surface layer of the charging member. Accordingly, it is, for example, shown that two ligands are coordinated with one Ti atom in the polymetalloxane forming the surface layer of charging member E1. In Table 10, "ROR=1" represents the case where a molar amount of ion-exchanged water equivalent to that of the alkoxy group bonding to the metal atom after formation of the complex was added.

Examples 2 to 25, Comparative Examples 1 to 13

Charging members E2 to E25 and charging members C1 to C13 were prepared in the same manner as in Example 1 except that surface layers were formed on electroconductive elastic roller 1 with coating liquids E2 to E25 and coating liquids C1 to C13, and were evaluated. The results of evaluation are collectively shown in Table 10. In Comparative Example 4, titanium oxide was present in the surface layer in the form of titanium oxide particles.

Examples 26 and 27, Comparative Example 14

O-Anisic acid and quinaldic acid as a compound for a ligand have strong affinity with electrons; hence, it is believed that the polymetalloxane formed with these compounds has a particularly shallow HOMO. To evaluate the charging members prepared with these compounds for a ligand under a severe condition in which abnormal discharge was more readily generated, the evaluation of abnormal discharge in the Examples above was performed on photosensitive members including a charge transport layer having an increased thickness (27.5 μm).

Abnormal discharge was evaluated in charging member E1 using o-anisic acid as the compound for a ligand (Example 26), charging member E22 using quinaldic acid (Example 27), and charging member C1 (Comparative Example 14).

An electrophotographic image was formed without pre-exposure. The charge voltage was set at −1210 V, and the transfer voltage was set at 1856 V. Except for these, the generation of abnormal discharge was evaluated in the same manner as in Example 1. The results are shown in Table 11. As a result, while the abnormal discharge was generated in charging member C1, the abnormal discharge was not observed in charging member E1 and charging member E22.

TABLE 10

| | Coating liquid No. | Charging member No. | Polymer (A) | Metal (M) | Ligand (L) | M/L | ROR | Abnormal discharge |
|---|---|---|---|---|---|---|---|---|
| Example 1 | E1 | E1 | P1 | Titanium | o-Anisic acid | 1/2 | — | A |
| Comparative Example 1 | C1 | C1 | P1 | — | — | — | — | B |
| Comparative Example 2 | C2 | C2 | — | Titanium | o-Anisic acid | 1/2 | — | B |
| Example 2 | E2 | E2 | P1 | Titanium | — | — | — | A |
| Comparative Example 3 | C3 | C3 | — | Titanium | — | — | — | B |
| Comparative Example 4 | C4 | C4 | P1 | Titanium oxide | — | — | — | B |
| Example 3 | E3 | E3 | P1 | Titanium | Acetylacetone | 1/2 | — | A |
| Example 4 | E4 | E4 | P1 | Titanium | Acetylacetone | 1/2 | — | A |
| Example 5 | E5 | E5 | P1 | Titanium | Acetylacetone | 1/2 | — | A |
| Example 6 | E6 | E6 | P1 | Titanium | Acetylacetone | 1/2 | — | A |
| Comparative Example 5 | C5 | C5 | — | Titanium | Acetylacetone | 1/2 | — | B |
| Example 7 | E7 | E7 | P2 | Titanium | o-Anisic acid | 1/2 | — | A |
| Example 8 | E8 | E8 | P3 | Titanium | o-Anisic acid | 1/2 | — | A |
| Example 9 | E9 | E9 | P4 | Titanium | o-Anisic acid | 1/2 | — | A |
| Comparative Example 6 | C6 | C6 | P2 | — | — | — | — | B |
| Comparative Example 7 | C7 | C7 | P3 | — | — | — | — | B |
| Comparative Example 8 | C8 | C8 | P4 | — | — | — | — | B |
| Example 10 | E10 | E10 | P5 | Titanium | o-Anisic acid | 1/2 | — | A |
| Example 11 | E11 | E11 | P6 | Titanium | o-Anisic acid | 1/2 | — | A |
| Comparative Example 9 | C9 | C9 | P5 | — | — | — | — | B |
| Comparative Example 10 | C10 | C10 | P6 | — | — | — | — | B |
| Example 12 | E12 | E12 | P1 | Tantalum | Acetylacetone | 1/1 | — | A |
| Example 13 | E13 | E13 | P1 | Aluminum | Acetoacetic acid ester | 1/1 | — | A |
| Comparative Example 11 | C11 | C11 | — | Tantalum | Acetylacetone | 1/1 | — | B |
| Comparative Example 12 | C12 | C12 | — | Aluminum | Acetoacetic acid ester | 1/1 | — | B |
| Example 14 | E14 | E14 | P1 | Titanium | o-Anisic acid | 1/1 | — | A |
| Example 15 | E15 | E15 | P1 | Titanium | o-Anisic acid | 1/2 | — | A |
| Example 16 | E16 | E16 | P1 | Titanium | o-Anisic acid | 1/3 | — | A |
| Example 17 | E17 | E17 | P1 | Titanium | Guaiacol | 1/2 | — | A |
| Example 18 | E18 | E18 | P1 | Titanium | Guaiacol | 1/2 | — | A |
| Example 19 | E19 | E19 | P1 | Titanium | Guaiacol | 1/2 | — | A |
| Example 20 | E20 | E20 | P1 | Titanium | Guaiacol | 1/2 | — | A |
| Comparative Example 13 | C13 | C13 | — | Titanium | Guaiacol | 1/2 | — | B |
| Example 21 | E21 | E21 | P1 | Titanium | o-Anisic acid | 1/2 | 1 | A |
| Example 22 | E22 | E22 | P1 | Titanium | Quinaldic acid | 1/2 | 1 | A |
| Example 23 | E23 | E23 | P1 | Titanium | 2-Acetylpyrrole | 1/2 | — | A |
| Example 24 | E24 | E24 | P1 | Titanium | N,N-Dimethylglycine | 1/2 | — | A |
| Example 25 | E25 | E25 | P1 | Titanium | Pentamethylcyclopentadienyl | 1/1 | — | A |

TABLE 11

| | Charging member No. | Polymer (A) | Metal (M) | Ligand (L) | M/L | ROR | Abnormal discharge |
|---|---|---|---|---|---|---|---|
| Example 26 | E1 | Poly(vinylphenol) | Titanium | o-Anisic acid | 1/2 | — | A |
| Example 27 | E22 | Poly(vinylphenol) | Titanium | Quinaldic acid | 1/2 | 1 | A |
| Comparative Example 14 | C1 | Poly(vinylphenol) | — | — | — | — | B |

Examples 28 to 34, Reference Example 1

<Preparation of Charging Members E28 to 34 and C15>

[Preparation of Electroconductive Elastic Rollers 2 to 9]

Electroconductive elastic rollers 2 to 8 were prepared in the same manner as in Example 1 except that the PMMA resin particles used in Example 1 were replaced with resin particles or heat expandable capsules for electrically insulating domains shown in Table 12. Further, electroconductive elastic roller 9 was prepared in the same manner as in Example 1 except that the PMMA resin particles used in Example 1 was not used. Electroconductive elastic rollers 5 to 9 were formed into a crown shape by extrusion, and were used without polishing the surface of the electroconductive elastic layer with a rotary grinding wheel. The surfaces of electroconductive elastic rollers 2 to 8 were observed with an optical microscope in the same manner as in Example 1 to measure the diameters, areas and heights of the electrically insulating domains. The results of observation are collectively shown in Table 12 with those of Example 1.

TABLE 12

| | Electroconductive elastic roller No. | Electrically insulating domains | Amount used (parts by mass) | Average diameter of electrically insulating domains | Average area of electrically insulating domains | Average height of electrically insulating domains |
|---|---|---|---|---|---|---|
| Example 1 | 1 | PMMA resin particles (trade name: Techpolymer MBX-5 manufactured by SEKISUI PLASTICS CO., LTD.) | 10 | 5 μm | 20 $\mu m^2$ | 3 μm |
| Example 28 | 2 | PMMA resin particles (trade name: Techpolymer MBX-8 manufactured by SEKISUI PLASTICS CO., LTD.) | 10 | 8 μm | 50 $\mu m^2$ | 4 μm |
| Example 29 | 3 | PE resin particles (trade name: Mipelon PM-200 manufactured by Mitsui Chemicals, Inc.) | 10 | 10 μm | 80 $\mu m^2$ | 4 μm |
| Example 30 | 4 | PU resin particles (trade name: Art-pearl C-600 manufactured by Negami Chemical Industrial Co., Ltd.) | 10 | 10 μm | 80 $\mu m^2$ | 4 μm |
| Example 31 | 5 | Heat-expansible capsule 1 | 4 | 50 μm | 2000 $\mu m^2$ | 20 μm |
| Example 32 | 6 | Heat-expansible capsule 2 | 4 | 53 μm | 2200 $\mu m^2$ | 22 μm |
| Example 33 | 7 | Heat-expansible capsule 3 | 4 | 20 μm | 320 $\mu m^2$ | 10 μm |
| Example 34 | 8 | Heat-expansible capsule 4 | 4 | 16 μm | 200 $\mu m^2$ | 8 μm |
| Reference Example 1 | 9 | — | — | — | — | — |

Heat-expansible capsules 1 to 4 used in electroconductive elastic rollers 5 to 8 were prepared as follows.

Production Example 1: Preparation of Heat-Expansible Capsule 1

Ion-exchanged water (4000 parts by mass), colloidal silica (9 parts by mass) as a dispersion stabilizer, and polyvinylpyrrolidone (0.15 parts by mass) were added to prepare a mixed aqueous solution. Next, polymerizable monomers, i.e., acrylonitrile (50 parts by mass), methacrylonitrile (45 parts by mass) and methyl methacrylate (5 parts by mass), a capsuled substance normal hexane (12.5 parts by mass), and a polymerization initiator dicumyl peroxide (0.75 parts by mass) were mixed to prepare a mixed oily solution. The mixed oily solution was added to the mixed aqueous solution, and sodium hydroxide (0.4 parts by mass) was further added to prepare a dispersion solution. The dispersion solution was mixed with stirring using a homogenizer for 3 minutes, and was placed into a polymerization reaction container purged with nitrogen. The reaction was performed under stirring at 200 rpm and 60° C. for 20 hours to prepare a reaction product. The reaction product was repeatedly filtered and washed with water, and was dried at 80° C. for 5 hours to prepare resin particles. The resin particles were disintegrated with an ultrasonic classifier, and were classified to yield heat-expansible capsule 1 having an average particle diameter of 12 μm.

Production Example 2: Preparation of Heat-Expansible Capsule 2

Resin particles were prepared by the same method as in Production Example 1 except that the polymerizable monomers used in Production Example 1 were replaced with methacrylonitrile (45 parts by mass) and methyl acrylate (55 parts by mass). The resin particles were classified in the same manner as in Production Example 1 to yield heat-expansible capsule 2 having an average particle diameter of 25 μm.

Production Example 3: Preparation of Heat-Expansible Capsule 3

Resin particles were prepared by the same method as in Production Example 1 except that the polymerizable monomers were replaced with acrylonitrile (37.5 parts by mass) and methacrylamide (62.5 parts by mass). The resin particles were classified in the same manner as in Production Example 1 to yield heat-expansible capsule 3 having an average particle diameter of 8 μm.

Production Example 4: Preparation of Heat-Expansible Capsule 4

Resin particles were prepared by the same method as in Production Example 1 except that the polymerizable monomers were replaced with acrylamide (100 parts by mass). The resin particles were classified in the same manner as in Production Example 1 to yield heat-expansible capsule 4 having an average particle diameter of 8 μm.

[Formation of Surface Layer]

Surface layers were formed in the same manner as in Example 1 except that electroconductive elastic rollers 2 to 9 were used. Charging members E28 to 34 and charging member C15 were prepared. It was verified that in charging members E28 to 34, electrically insulating domains were exposed on the surfaces of the respective electroconductive elastic layers, and the surface layers were formed thereon as in Example 1.

<Evaluation of Abnormal Discharge>

Charging members E28 to 34 and charging member C15 were evaluated for abnormal discharge. In the evaluation of abnormal discharge, electrophotographic images were formed without pre-exposure. The charge voltage was set at −1261 V. The transfer voltage was increased from 1377 V, and the voltage at which abnormal discharge generated was recorded. The results are collectively shown in Table 13.

TABLE 13

| | Charging member No. | Electro-conductive elastic roller No. | Electrically insulating domains | Transfer voltage during generation of abnormal discharge |
|---|---|---|---|---|
| Example 1 | E1 | 1 | PMMA resin particles | 2096 V |
| Example 28 | E28 | 2 | PMMA resin particles | 2215 V |
| Example 29 | E29 | 3 | PE resin particles | 1857 V |
| Example 30 | E30 | 4 | PU resin particles | 1975 V |
| Example 31 | E31 | 5 | Heat-expansible capsule 1 | 2575 V |
| Example 32 | E32 | 6 | Heat-expansible capsule 2 | 2575 V |
| Example 33 | E33 | 7 | Heat-expansible capsule 3 | 2575 V |
| Example 34 | E34 | 8 | Heat-expansible capsule 4 | 2575 V |
| Reference Example 1 | C15 | 9 | — | 1617 V |

These results show that the charging member according to this aspect can significantly reduce generation of unevenness of images attributed to abnormal discharge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-199271, filed Oct. 7, 2016 and Japanese Patent Application No. 2017-172099, filed Sep. 7, 2017 which are hereby incorporated by reference herein in their entirety.

What is claimed is:

1. A charging member comprising:

an electroconductive support;

an electroconductive elastic layer; and a surface layer, the electroconductive elastic layer containing electrically insulating domains such that at least a part of the electrically insulating domains is exposed on a surface of the electroconductive elastic layer, the surface layer containing a polymetalloxane having a structure represented by Structural Formula (a1);

wherein M1 in Structural Formula (a1) is bonded to a carbon atom in a structural unit represented by Structural Formula (a2) with a linking group represented by Structural Formula (a3):

Structural Formula (a1)

$$M1O_{(k-(s+1))/2}(L1)_s$$

Structural Formula (a2)

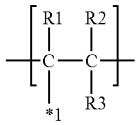

Structural Formula (a3)

$$*2—O—Z—*1$$

where in Structural Formula (a1),

M1 represents a metal atom selected from the group consisting of Ti, Zr, Hf, V, Nb, Ta, W, Al, Ga, In and Ge;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5;

s represents an integer of 0 or more and (k−2) or less; and

L1 represents a ligand having a structure represented by Formula (b) or a ligand having a structure represented by Formula (c);

(b)

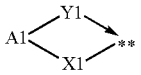

where in Formula (b),

X1 represents a structure represented by one of Formulae (1) to (4);

Y1 represents a group having a site of coordination with M1 in Structural Formula (a1);

A1 represents a direct bond or an atomic group needed to form a 4- to 8-membered ring with M1, X1 and Y1; and a symbol "**" represents a site of bonding to or coordination with M1;

(1)

(2)

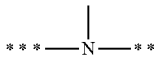

(3)

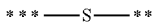

(4)

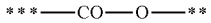

where in Formulae (1) to (4), a symbol "" represents a site of bonding to M1 in Structural Formula (a1); and a symbol "*" represents a site of bonding to A1 in Formula (b);

(c)

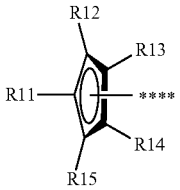

where in Formula (c),

R11 to R15 each independently represent a hydrogen atom, an alkyl group having 1 to 4 carbon atoms, or a trimethylsilyl group; and a symbol "****" represents a site of coordination with M1 in Structural Formula (a1);

where in Structural Formula (a2),

R1 to R3 each independently represent a hydrogen atom or an alkyl group having 1 to 3 carbon atoms; and a symbol "*1" represents a site of bonding to Z in Structural Formula (a3); and where in Structural Formula (a3), Z represents a substituted or unsubstituted phenylene group, provided that the substituent in the substituted phenylene group is a halogen atom or an alkyl group having 1 to 3 carbon atoms;

a symbol "*1" represents a site of bonding to the symbol "*1" in Structural Formula (a2); and a symbol "*2" represents a site of bonding to M1 in Structural Formula (a1).

2. The charging member according to claim 1, wherein A1 in Formula (b) represents a direct bond, an alkylene group, an alkenylene group, or an atomic group having a ring selected from the group consisting of a substituted or unsubstituted benzene ring, naphthalene ring, pyrrole ring, thiophene ring, furan ring, pyridine ring, indole ring, benzothiophene ring, benzofuran ring, quinoline ring and isoquinoline ring.

3. The charging member according to claim 1, wherein Y1 in Formula (b) is a hydroxy group, an alkoxy group, a substituted or unsubstituted aryloxy group, a carbonyl group, a thiol group, an alkylthio group, a substituted or unsubstituted arylthio group, a thiocarbonyl group, a substituted or unsubstituted amino group, a substituted or unsubstituted imino group, a group having a substituted or unsubstituted aliphatic heterocyclic skeleton, or a group having a substituted or unsubstituted aromatic heterocyclic skeleton.

4. The charging member according to claim 1, wherein A1 in Formula (b) represents a single bond, an alkylene group, or an atomic group having a ring selected form the group consisting of a substituted or unsubstituted benzene ring, naphthalene ring, pyrrole ring, thiophene ring, furan ring, pyridine ring, indole ring, benzothiophene ring, benzofuran ring, quinoline ring and isoquinoline ring.

5. The charging member according to claim 1, wherein s in Structural Formula (a1) is an integer of 1 or more and (k−2) or less.

6. The charging member according to claim 1, wherein in Formula (b), a ring formed with A1, M1, X1 and Y1 is a 5-membered ring or a 6-membered ring.

7. The charging member according to claim 1, wherein in the case that X1 in Formula (b) is a structure represented by Formula (1), Formula (b) is represented by one of Formulae (5) to (9):

(5)

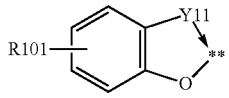

(6)

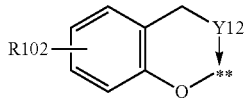

(7)

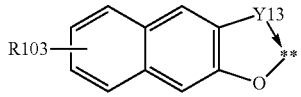

(8)

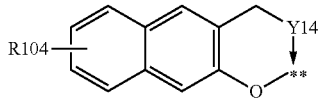

where in Formulae (5) to (8), R101 to 104 each independently represent a hydrogen atom, a methoxy group or an ethoxy group; Y11 to Y14 each independently represent a methoxy group, an ethoxy group, a formyl group, a methylcarbonyl group, an ethylcarbonyl group, a methoxycarbonyl group, an ethoxycarbonyl group, a dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methanimino group, an ethanimino group, a group having a pyridine skeleton, a group having a quinoline skeleton, or a group having an isoquinoline skeleton; and a symbol "**" represents a site of bonding to M1 in Structural Formula (a1);

(9)

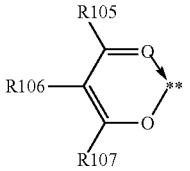

where in Formula (9), R105 is an alkyl group having 1 to 4 carbon atoms, a phenyl group, or a benzyl group; R106 is a hydrogen atom or an alkyl group having 1 to 4 carbon atoms; R107 is an alkyl group having 1 to 4 carbon atoms, an alkoxy group having 1 to 4 carbon atoms, a phenyl group, or a benzyl group; and a symbol "**" represents a site of bonding to M1 in Structural Formula (a1).

8. The charging member according to claim 1, wherein in the case that X1 in Formula (b) is a structure represented by one of Formulae (2) to (4), A1 is a single bond, a methylene group, an ethylene group or a trimethylene group;

X1 is a structure represented by one of Formulae (2a) to (2c), (3) and (4); and

Y1 is a methoxy group, an ethoxy group, a formyl group, a methylcarbonyl group, an ethylcarbonyl group, a methoxycarbonyl group, an ethoxycarbonyl group, a dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methanimino group, an ethanimino group, a group having a pyridine skeleton, a group having a quinoline skeleton, or a group having an isoquinoline skeleton:

(2a)

*—$NCH_3$—

(2b)

*—NH—

(2c)

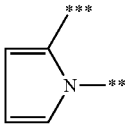

(3)

*—S—

(4)

*—CO—O— where in Formulae (2a) to (2c), (3) and (4), a symbol "" represents a site of bonding to M1 in Structural Formula (a1); and a symbol "*" represents a site of bonding to A1 in Formula (b).

9. The charging member according to claim 1, wherein the electrically insulating domains are projected from the surface of the electroconductive elastic layer.

10. The charging member according to claim 1, wherein the electrically insulating domains contain hollow resin particles.

11. A process cartridge detachably attachable to a main body of an electrophotographic apparatus, the process cartridge integrally supporting an electrophotographic photosensitive member and a charging member for charging the surface of the electrophotographic photosensitive member, the charging member comprising an electroconductive support, an electroconductive elastic layer and a surface layer, the electroconductive elastic layer containing electrically insulating domains such that at least a part of the electrically insulating domains is exposed on the surface of the electroconductive elastic layer, and the surface layer containing a polymetalloxane having a structure represented by Structural Formula (a1); wherein M1 in Structural Formula (a1) is bonded to a carbon atom in a structural unit represented by Structural Formula (a2) with a linking group represented by Structural Formula (a3):

Structural Formula (a1)

$M1O_{(k-(s+1))/2}(L1)_s$

Structural Formula (a2)

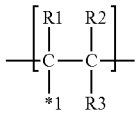

Structural Formula (a3)

*2—O—Z—*1 where in Structural Formula (a1),

M1 represents a metal atom selected from the group consisting of Ti, Zr, Hf, V, Nb, Ta, W, Al, Ga, In and Ge;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5;

s represents an integer of 0 or more and (k−2) or less; and

L1 represents a ligand having a structure represented by Formula (b) or a ligand having a structure represented by Formula (c);

(b)

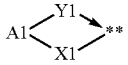

where in Formula (b),

X1 represents a structure represented by one of Formulae to (4);

Y1 represents a group having a site of coordination with M1 in Structural Formula (a1);

A1 represents a direct bond or an atomic group needed to form a 4- to 8-membered ring with M1, X1 and Y1; and a symbol "**" represents a site of bonding to or coordination with M1;

*—O— (1)

*—N— (2)

*—S— (3)

*—CO—O— (4)

where in Formulae (1) to (4), a symbol "" represents a site of bonding to M1 in Structural Formula (a1); and a symbol "*" represents a site of bonding to A1 in Formula (b);

(c)

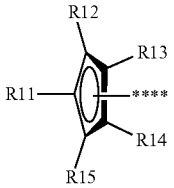

where in Formula (c),

R11 to R15 each independently represent a hydrogen atom, an alkyl group having 1 to 4 carbon atoms, or a trimethylsilyl group; and a symbol "****" represents a site of coordination with M1 in Structural Formula (a1);

where in Structural Formula (a2),

R1 to R3 each independently represent a hydrogen atom or an alkyl group having 1 to 3 carbon atoms; and a symbol "1" represents a site of bonding to Z in Structural Formula (a3); and where in Structural Formula (a3), Z represents a substituted or unsubstituted phenylene group, provided that the substituent in the substituted phenylene group is a halogen atom or an alkyl group having 1 to 3 carbon atoms;

a symbol "*1" represents a site of bonding to the symbol "*1" in Structural Formula (a2); and a symbol "*2" represents a site of bonding to M1 in Structural Formula (a1).

12. An electrophotographic apparatus comprising an electrophotographic photosensitive member and a charging member for charging the surface of the electrophotographic photosensitive member, wherein the charging member comprising an electroconductive support, an electroconductive elastic layer and a surface layer, the electroconductive elastic layer containing electrically insulating domains such that at least a part of the electrically insulating domains is exposed on the surface of the electroconductive elastic layer, and the surface layer containing a polymetalloxane having a structure represented by Structural Formula (a1); wherein M1 in Structural Formula (a1) is bonded to a carbon atom in a structural unit represented by Structural Formula (a2) with a linking group represented by Structural Formula (a3):

Structural Formula (a1)

$M1O_{(k-(s+1))/2}(L1)_s$

Structural Formula (a2)

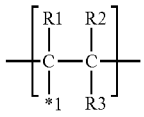

Structural Formula (a3)

*2—O—Z—*1 where in Structural Formula (a1),

M1 represents a metal atom selected from the group consisting of Ti, Zr, Hf, V, Nb, Ta, W, Al, Ga, In and Ge;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5;

s represents an integer of 0 or more and (k−2) or less; and

L1 represents a ligand having a structure represented by Formula (b) or a ligand having a structure represented by Formula (c);

(b)

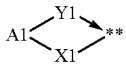

where in Formula (b),

X1 represents a structure represented by one of Formulae (1) to (4);

Y1 represents a group having a site of coordination with M1 in Structural Formula (a1);

A1 represents a direct bond or an atomic group needed to form a 4- to 8-membered ring with M1, X1 and Y1; and a symbol "**" represents a site of bonding to or coordination with M1;

*—O— (1)

*—N— (2)

*—S— (3)

*—CO—O— (4)

where in Formulae (1) to (4), a symbol "" represents a site of bonding to M1 in Structural Formula (a1); and a symbol "*" represents a site of bonding to A1 in Formula (b);

(c)

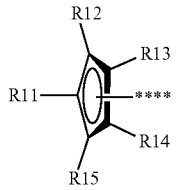

where in Formula (c),

R11 to R15 each independently represent a hydrogen atom, an alkyl group having 1 to 4 carbon atoms, or a trimethylsilyl group; and a symbol "****" represents a site of coordination with M1 in Structural Formula (a1);

where in Structural Formula (a2),

R1 to R3 each independently represent a hydrogen atom or an alkyl group having 1 to 3 carbon atoms; and a symbol "*1" represents a site of bonding to Z in Structural Formula (a3); and where in Structural Formula (a3), Z represents a substituted or unsubstituted phenylene group, provided that the substituent in the substituted phenylene group is a halogen atom or an alkyl group having 1 to 3 carbon atoms;

a symbol "*1" represents a site of bonding to the symbol "*1" in Structural Formula (a2); and a symbol "*2" represents a site of bonding to M1 in Structural Formula (a1).

* * * * *